US008523165B2

(12) United States Patent
Kunieda et al.

(10) Patent No.: US 8,523,165 B2
(45) Date of Patent: Sep. 3, 2013

(54) RECORDING MEDIA SHEET PROCESSING SYSTEM, IMAGE FORMING SYSTEM INCLUDING SAME, AND INSERTION METHOD USED THEREIN

(75) Inventors: Akira Kunieda, Tokyo (JP); Kiichiroh Gotoh, Kanagawa (JP); Junichi Iida, Kanagawa (JP); Takeshi Sasaki, Kanagawa (JP); Masahiro Tamura, Kanagawa (JP); Satoshi Saito, Kanagawa (JP); Ikuhisa Okamoto, Kanagawa (JP); Junichi Tokita, Kanagawa (JP); Shingo Matsushita, Tokyo (JP); Takahiro Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 324 days.

(21) Appl. No.: 13/064,888

(22) Filed: Apr. 25, 2011

(65) Prior Publication Data

US 2011/0277418 A1 Nov. 17, 2011

(30) Foreign Application Priority Data

May 11, 2010 (JP) ..... 2010-109453

(51) Int. Cl.
*B65H 33/04* (2006.01)

(52) U.S. Cl.
USPC ..... 270/58.06; 53/117; 53/529; 399/407

(58) Field of Classification Search
USPC ..... 270/1.02, 58.06; 53/52, 55, 116, 53/117, 528, 529; 399/407, 408
See application file for complete search history.

(56) References Cited

U.S. PATENT DOCUMENTS

| | | | | |
|---|---|---|---|---|
| 4,543,768 | A * | 10/1985 | Nishikawa et al. | 53/117 |
| 4,733,856 | A * | 3/1988 | Gunther, Jr. | 270/1.02 |
| 4,784,379 | A * | 11/1988 | Vander Syde et al. | 270/58.06 |
| 7,231,750 | B2 * | 6/2007 | Woodman et al. | 53/429 |
| 7,637,490 | B2 * | 12/2009 | Kapturowski et al. | 270/58.06 |
| 7,681,881 | B2 | 3/2010 | Kunieda et al. | |

(Continued)

FOREIGN PATENT DOCUMENTS

| | | | |
|---|---|---|---|
| JP | 4089318 | B2 | 5/2008 |
| JP | 2009-067537 | A | 4/2009 |
| JP | 2009-149435 | A | 7/2009 |

OTHER PUBLICATIONS

English language abstract for Patent Publication No. JP-2004-045650 which corresponds to JP-4089318-B2.

*Primary Examiner* — Ren Yan
(74) *Attorney, Agent, or Firm* — Harness, Dickey & Pierce, P.L.C.

(57) ABSTRACT

A recording media sheet processing system includes a folding device including a folding unit to fold a sheet and a squeezing unit to squeeze the folded sheet, an insertion device to insert in an envelope an enclosure, and a controller. The folding device. The controller includes an envelope selector, a selector for selecting whether to fold the sheet and a folding style of the sheet, a first storage unit for storing a folding-related equivalent quantity into which a quantity of each sheet is converted corresponding to the folding style and the number of times the sheet is squeezed, a second storage unit for storing a maximum quantity of sheets insertable, a calculator to calculate a total converted quantity of the enclosure, a determination unit to determine whether the selected envelope type accommodates the enclosure, and a squeezing setter to set the number of times of squeezing.

12 Claims, 18 Drawing Sheets

(56) References Cited

U.S. PATENT DOCUMENTS

| | | | |
|---|---|---|---|
| 7,802,789 | B2 | 9/2010 | Tokita et al. |
| 2009/0066003 | A1 | 3/2009 | Kunieda et al. |
| 2009/0206547 | A1 | 8/2009 | Tokita et al. |
| 2009/0283961 | A1 | 11/2009 | Saito et al. |
| 2010/0207314 | A1 | 8/2010 | Hattori et al. |

* cited by examiner

1-D

RECORDING MEDIA SHEET PROCESSING SYSTEM, IMAGE FORMING SYSTEM INCLUDING SAME, AND INSERTION METHOD USED THEREIN

CROSS-REFERENCE TO RELATED APPLICATIONS

This patent specification is based on and claims priority from Japanese Patent Application No. 2010-109453, filed on May 11, 2010 in the Japan Patent Office, which is hereby incorporated by reference herein in its entirety.

BACKGROUND OF THE INVENTION

1. Field of the Invention

The present invention generally relates to a sheet processing system including an insertion device that inserts recording media sheets in envelopes, an image forming system including same, and a method of inserting sheets in envelopes.

2. Description of the Background Art

There are post-processing apparatuses that, in addition to aligning, sorting, folding, stapling, and/or punching sheets of recording media, are also capable of automatically enveloping the sheets (hereinafter "enclosure") in envelopes. Such post-processing apparatuses typically determine whether the envelope can accommodate the enclosure based on the sizes of the envelope and the enclosure, which are either input manually or measured automatically by the apparatus.

Accordingly, various approaches have been proposed to handle a mismatch between the size of the envelope and that of the enclosure, for example, by having the apparatus indicate that the envelope cannot accommodate the enclosure.

Alternatively, JP-2004-045650-A proposes an image forming apparatus provided with a post-processing unit that makes the processing efficient and reduces the work of the user as follows. The image forming apparatus includes an image forming unit to form images on sheets of recording media according to image data transmitted from an image reading unit; the post-processing unit; a sheet size input unit via which the user inputs the size of the sheet to be inserted in the envelope; an envelope size input unit via which the user inputs the size of the envelope; and a determination unit to determine whether the envelope accommodates the enclosure based on the sizes of the enclosure and the envelope. When the enclosure is larger than the envelope, the post-processing unit folds the enclosure, so that the folded enclosure can be inserted in the envelope.

The above-described approach, however, has several drawbacks. For example, this approach does not take account of a case in which multiple folded sheets are further flattened to make the whole bunch thinner, and therefore it is possible that the apparatus mistakenly assumes that the folded sheets cannot be accommodated in the envelopes. Additionally, although the apparatus can determine whether the folded sheets are too thick to fit into the envelope by measuring the thickness of the folded sheets, the folded sheets are wasted if the apparatus makes the determination that the folded sheets do not fit the envelope only after the sheets are folded.

SUMMARY OF THE INVENTION

One illustrative embodiment of the present invention provides a recording media sheet processing system that includes a folding device, an insertion device to insert in an envelope an enclosure including a folded sheet, and a controller operatively connected to the folding device and the insertion device. The folding device includes a folding unit to fold a sheet of recording media and a squeezing unit to squeeze a folded portion of the folded sheet. The controller includes an envelope selector for selecting an envelope type from a group of selectable predetermined envelope types, a selector for selecting whether to fold the sheet and a folding style of the sheet from a group of selectable predetermined folding styles, a first storage unit, a second storage unit, a calculator to calculate a total converted quantity of the enclosure, a determination unit, and a squeezing setter.

The first storage unit stores a first folding-related equivalent quantity into which a quantity of each sheet not to be squeezed by the squeezing unit of the folding device is converted corresponding to the selected folding style, and the second storage unit stores a maximum quantity of sheets insertable in each envelope type. The total converted quantity of the enclosure is calculated using the first folding-related equivalent quantity stored in the first storage unit and the folding style selected by the selector. The determination unit compares the calculated total converted quantity of the enclosure with the maximum quantity of sheets insertable in the selected envelope type, and then determines whether the selected envelope type accommodates the enclosure before the recording media sheet processing system processes the sheet. The squeezing setter sets the number of times the squeezing unit squeezes the sheet and increases that number of times when the determination unit determines that insertion is not feasible. When the determination unit determines that insertion is feasible, the sheet processing is started and the insertion device inserts the enclosure in the envelope.

Another illustrative embodiment provides a method of inserting in an envelope an enclosure including a folded sheet. The method includes a step of selecting an envelope type from a group of selectable predetermined envelope types, a step of selecting whether to fold the sheet inserted in the envelope and a folding style of the sheet from a group of selectable predetermined folding styles, a step of obtaining, from a pre-stored table, a first folding-related equivalent quantity for each sheet of the enclosure, into which a quantity of each sheet is converted corresponding to the selected folding style, a step of obtaining, from a pre-stored table, a maximum quantity of sheets insertable in the selected envelope type, a step of calculating a total converted quantity of the enclosure using the first folding-related equivalent quantity and the selected folding style, a step of comparing the calculated total converted quantity of the enclosure with the maximum quantity of sheets insertable in the selected envelope type, determining whether the selected envelope type accommodates the enclosure before the sheet is processed, a step of increasing the number of times the folded sheet is squeezed when the determination unit determines that insertion is not feasible, and a step of starting processing the sheet and inserting the enclosure in the envelope when the determination unit determines that insertion is feasible.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
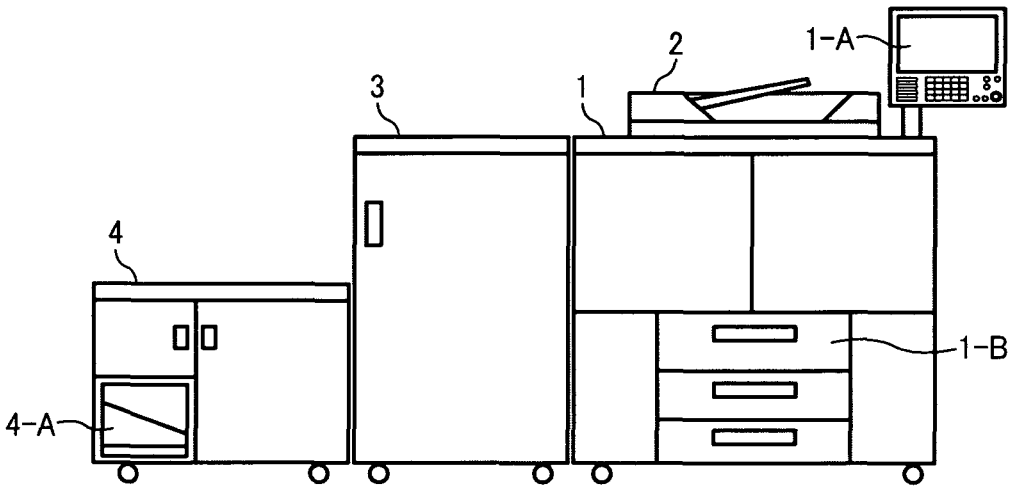
FIG. 1 is a diagram illustrating a configuration of an image forming system according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming system according to an illustrative embodiment of the present invention is described.

FIG. 1 is a front view illustrating a configuration of an image forming system according to an embodiment of the present invention.

In FIG. 1, the image forming system according to the present embodiment includes an image forming apparatus 1, a folding and stapling device 3, and an insertion device or enclosing device 4. The image forming apparatus 1 includes a multifunction peripheral (MFP) as a main body. An automatic document feeder (ADF) 2 and an operation panel 1-A including a display 1-D (shown in FIG. 24) are provided above the MFP, and multiple feed cassettes 1-B are provided beneath the MFP. The folding and stapling device 3 is a so-called post-processing apparatus, and hereinafter referred to as the post-processing apparatus 3.

One of the multiple feed cassettes 1-B can store envelopes, and another feed cassette 1-B can store sheets of recording media to be inserted in the envelopes (hereinafter "enclosures"). To insert the enclosures in the envelopes in this system, the enclosures and the envelopes are transported to the post-processing apparatus 3 and the insertion device 4, respectively. The post-processing apparatus 3 folds the enclosures as required, and then the insertion device 4 inserts the enclosures in the respective envelopes, after which the envelopes are discharged onto a stack tray 4-A.

Figure 2:
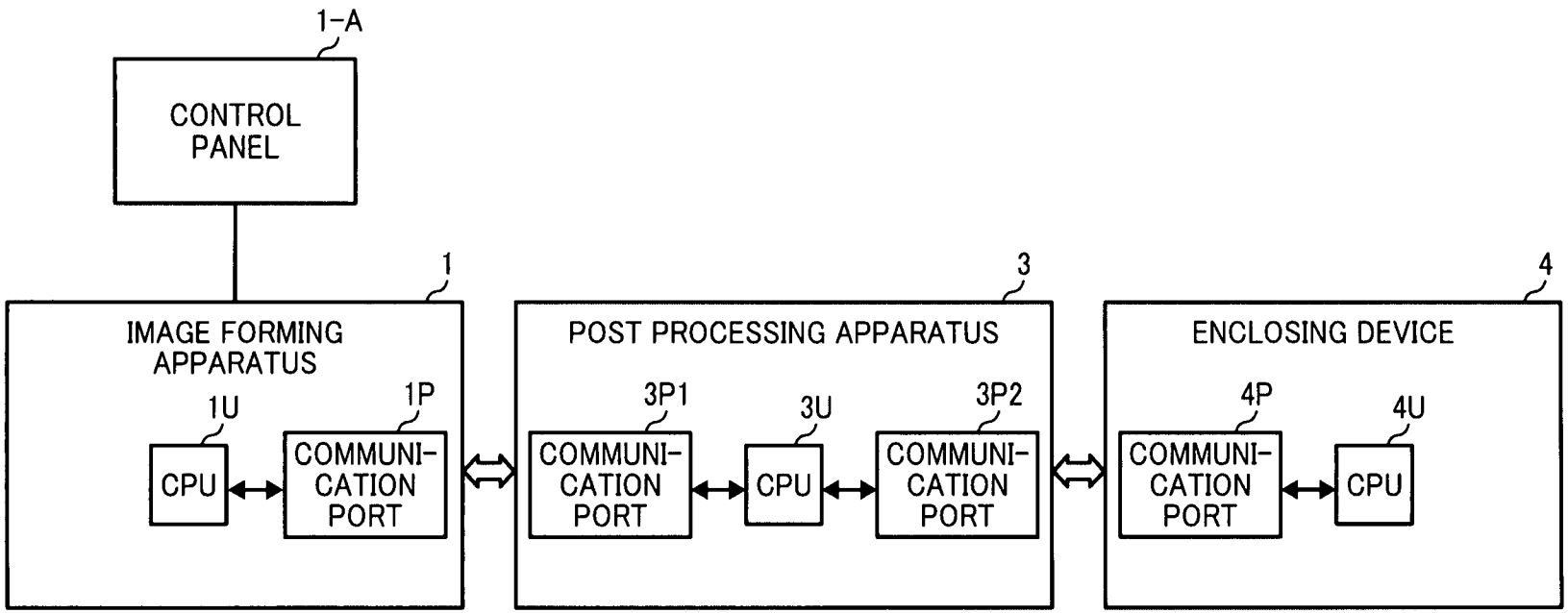
FIG. 2 is a block diagram illustrating a schematic configuration of an online control system of the image forming system shown in FIG. 1.

FIG. 2 is a block diagram illustrating a schematic configuration of an online control system of the image forming system shown in FIG. 1.

In the online image forming system shown in FIG. 2, the post-processing apparatus 3 is connected to the image forming apparatus 1, and the insertion device 4 is connected to post-processing apparatus 3. The image forming apparatus 1, the post-processing apparatus 3, and the insertion device 4 include central processing units (CPUs) 1U, 3U, and 4U, respectively. Additionally, the image forming apparatus 1 includes a communication port 1P. The post-processing apparatus 3 includes communication ports 3P1 and 3P2. The insertion device 4 includes a communication port 4P. Thus, the image forming apparatus 1 and the post-processing apparatus 3 communicate with each other via the communication ports 1P and 3P1, and the post-processing apparatus 3 and the insertion device 4 communicate with each other via the communication ports 3P2 and 4P. The operation panel 1-A is connected to the MFP of the image forming apparatus 1 via an interface (I/F) not shown and displays various indications such as those shown in FIGS. 24, 25, and 27, instructed by the CPU 1U. The CPUs 1U, 3U, and 4U; and the operation panel 1-A can together form a controller of the image forming system. Users can input instructions or data to the image forming apparatus 1 by pressing keys on the operation panel 1-A or touching the display 1-D.

Each of the image forming apparatus 1, the post-processing apparatus 3, and the insertion device 4 further includes a read-only memory (ROM) and a random-access memory (RAM). Each of the CPUs 1U, 3U, and 4U reads out program codes from the ROM, runs the program codes in the RAM, and then performs operations defined by the program codes using the RAM as a work area and a data buffer. Thus, the CPUs 1U, 3U, and 4U control the indications on the display 1-D (shown in FIG. 24) of the operation panel 1-A and operations of the image forming system.

These apparatuses and the device are connected in series electrically via the communication ports 1P, 3P1, 3P2, and 4P as well as mechanically via at least a sheet conveyance path. Thus, when the image forming system operates online, all the image forming apparatus 1, the post-processing apparatus 3, and the insertion device 4 can be controlled electrically simultaneously. The processes in the flowcharts shown in FIGS. 26 and 28, described later, are instructed by the CPU 1U and executed by the respective apparatuses and the device.

Figure 3:
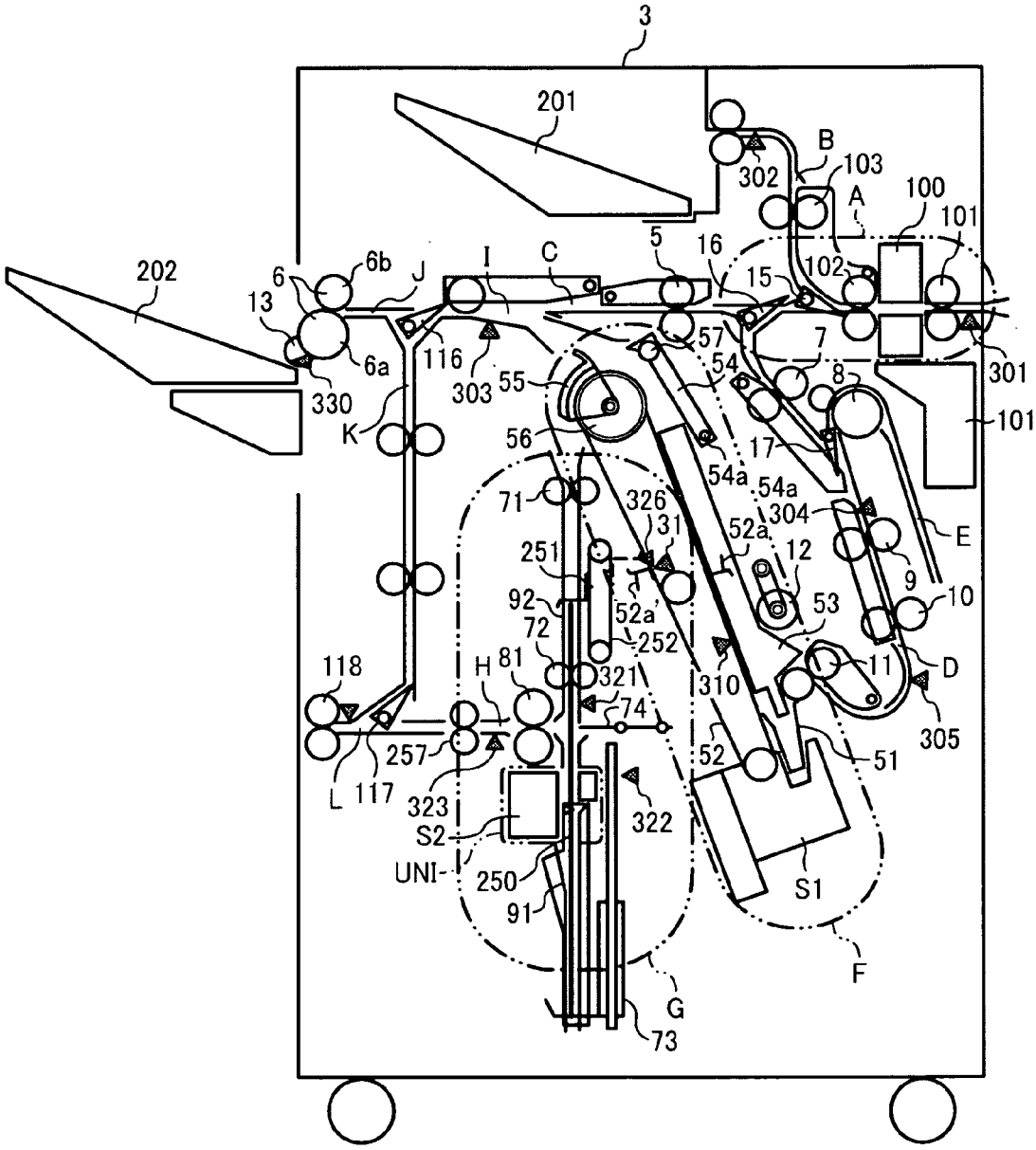
FIG. 3 is a diagram that illustrates a configuration of a post-processing apparatus.

FIG. 3 is a diagram that illustrates a configuration of the post-processing apparatus 3.

The post-processing apparatus 3 according to the present embodiment is connected to a side of the image forming apparatus 1 as shown in FIG. 1, and sheets discharged from the image forming apparatus 1 are conveyed to the post-processing apparatus 3. The post-processing apparatus 3 includes a conveyance path A along which a punch unit 100 for punching the sheets one by one is provided, a conveyance path B leading to an upper tray 201, along which a pair of conveyance rollers 103 is provided, a conveyance path C leading to a shift tray 202, along which a pair of pressure rollers 5 and a pair of discharge rollers 6 are provided, and a conveyance path D leading to a processing tray F on which the sheets are aligned and stapled. The sheet transported from the image forming apparatus 1 is transported along the conveyance path A and then is sent to the conveyance path B, C, or D by the separation pawls 15 and 16. The processing tray F is hereinafter also referred to as the edge-stapling tray F. A bundle of sheets aligned or aligned and stapled on the edge-stapling tray F along its side is led by a bifurcation guide 54 and a movable guide 55 to the conveyance path C leading to the shift tray 202 or a processing tray G for folding and stapling the bundle of sheets along its centerline. The processing tray G is hereinafter also referred to as the center-folding tray G. The sheets folded on the center-folding tray G are transported through a conveyance path H and further transported by a pair of discharge rollers 118 to the insertion device 4 provided downstream from the post-processing apparatus 3 in a direction in which the sheets are conveyed through the image forming system (hereinafter "sheet conveyance direction"). A pair of conveyance rollers 257 is provided along the conveyance path H.

Additionally, a pair of conveyance rollers 7 and a separation pawl 17 are provided along the conveyance path D. The separation pawl 17 is retained at a position shown in FIG. 3 by a low-load spring. After a trailing edge of the sheet passes by the separation pawl 17, at least one of pairs of conveyance rollers 9 and 10, and a discharge roller 11 is rotated in reverse, thereby leading the trailing edge of the sheet along a guide roller 8 to a stack portion E. By repeating this operation, a subsequent sheet can be stacked on the sheet in the stack portion E. Then, the multiple sheets can be transported from the stack portion E at a time.

The image forming apparatus 1 further includes an entry detector 301 for detecting the sheet received by the post-processing apparatus 3. The entry detector 301 is provided along the conveyance path A, which is a common path for sheets led to the conveyance paths B, C, or D. A pair of entrance rollers 110, the punch unit 100, and a punch chad container 101, a pair of conveyance rollers 102, and the separation pawls 15 and 16 are provided downstream from the entry detector 301, in that order, in the sheet conveyance direction. The separation pawls 15 and 16 are retained at the positions shown in FIG. 3 by springs, respectively. When a solenoid is turned on, the separation pawls 15 and 16 are rotated up and down in FIG. 3, respectively. Rotation of the separation pawls 15 and 16 switches the route of the sheet among the conveyance paths B, C, and D. To guide the sheet to the conveyance path B, the separation pawl 15 is at the position shown in FIG. 3 and the solenoid is off. To guide the sheet to the conveyance path C, the solenoid is turned on, thereby rotating the separation pawls 15 and 16 upward and downward, respectively, from the position shown in FIG. 3. To guide the sheet to the conveyance path D, the separation pawl 16 is at the position shown in FIG. 3 and thus the solenoid is off. The separation pawl 15 is rotated upward from the position shown in FIG. 3 by turning on the solenoid.

The sheet transported through the conveyance path C and that transported through the conveyance path D are sent to a conveyance path I, which is bifurcated into conveyance paths J and K by a separation pawl 116. Both the sheet that is not stapled and a bundle of stapled sheets can be transported through the conveyance path K. The sheet transported through the conveyance path H and that transported through the conveyance path K are sent to a conveyance path L via a separation pawl 117. Then, the sheet is transported by the pair of discharge rollers 118 to the downstream apparatus that in the present embodiment is the insertion device 4.

The discharge rollers 6, a return roller 13, a sheet detector 330, the shift tray 202, an elevation unit for the shift tray 202, and a shift mechanism for shifting the shift tray 202 together form a sheet stacker of the post-processing apparatus 3. The sheet stacker has a known configuration, and thus the description thereof omitted.

The processing tray F is for edge stapling. The sheets guided by the discharge roller 11 are staked one on another n the edge-stapling tray F. An alignment roller 12 aligns the sheets sent to the stapling tray F one by one in a longitudinal direction of the sheet in parallel to the sheet conveyance direction, and a pair of jogger fences 53 pushes the sheets from both sides to align the sheets in a transverse direction or sheet width direction, perpendicular to the sheet conveyance direction. The CPU 3U transmits a stapling signal to a side stapler S1, thereby causing it to staple the bundle of sheets, in intervals between printing jobs, that is, after the last sheet in a job is stacked on the processing tray F and before the initial sheet of a subsequent job is transported thereto. A release belt 52 provided with a pair of release pawls 52*a* and 52*a*' forwards the bundle of sheets to the discharge rollers 6 (a driving roller 6*a* and a driven roller 6*b*) immediately after stapling. At this time, the shift tray 202 is at an upper position to receive the sheets (receiving position).

A home position (HP) detector 311 detects the positions of the release pawls 52*a* and 52*a*', that is, whether they are at home positions. The HP detector 311 is turned on and off by the release pawl 52*a* provided at the release belt 52. The two release pawls 52*a* and 52*a* are provided on an outer circumferential surface of the release belt 52 at positions facing each other. The release pawls 52*a* and 52*a*' transport the bundle stacked on the processing tray F alternately. Additionally, the release belt 52 may be rotated in reverse as required so that the leading side of the sheets can be aligned on the back of the release pawl 52*a*' facing the release pawl 52*a* on standby, waiting for the bundle.

The release belt 52 is driven by a motor, not shown. The release belt 52 and a driving pulley for it are provided at a driving shaft of the release belt 52, at a center of alignment in the sheet width direction, and multiple release rollers 56 are positioned at predetermined constant intervals symmetrically. The peripheral velocity of the release rollers 56 is higher than that of the release belt 52. The alignment roller 12 is caused to swing on a support point by a solenoid. Accordingly, the alignment roller 12 intermittently pushes the sheet on the edge-stapling tray F, thereby causing the sheet to constant a back fence 51. The alignment roller 12 rotates counterclockwise. A jogger motor capable of rotating in both normal and reverse directions drives the pair of jogger fences 53 via a timing belt, and thus the jogger fences 53 move reciprocally in the sheet width direction perpendicular to the sheet conveyance direction.

A stapler motor capable of rotating in both normal and reverse directions drives the side stapler S1 via a timing belt, and thus the side stapler S1 moves in the sheet width direction to staple a predetermined position in an edge portion of the sheets. A stapler HP detector is provided in an end portion of the movable range of the side stapler S1 to detect whether the side stapler S1 is at its home position. The position in the sheet width direction stapled by the side stapler S1 is determined by the amount by which the side stapler S1 moves from the home position.

The bifurcation guide 54 and the movable guide 55 guide the bundle of sheets to the center-folding tray G. The bifurcation guide 54 is rotatable vertically in FIG. 3 around a support point 54*a*, and a rotary pressure roller 57 is provided on the downstream side of the bifurcation guide 54. The bifurcation guide 54 is pressed to the release roller 56 by a spring. The bifurcation guide 54 is driven by a cam, and its rotational position is controlled by the cam.

The movable guide 55 is rotatably supported by a rotation shaft of the release roller 56, and a link arm is rotatably connected to the movable guide 55 so that the movable guide 55 can rotate a predetermined angle range via the link arm. The movable guide 55 is driven similarly by the cam that drives the bifurcation guide 54, and its rotational position is controlled by the cam. Thus, the bifurcation guide 54 and the movable guide 55 are driven in conjunction with each other by the identical cam.

As shown in FIG. 3, the center-folding tray G is positioned substantially vertically, downstream from the sheet guide unit constructed of the movable guide 55 and the release roller 56. A center-folding mechanism is provided in a center portion of the center-folding tray G, and an upper bundle guide 92 and a lower bundle guide 91 are provided above and beneath the center-folding mechanism, respectively. A pair of upper bundle conveyance rollers 71 and a pair of lower bundle conveyance rollers 72 are provided at an upper position and a lower position, respectively, of the upper bundle guide 92. A pair of jogger fences 250 extending along a side of the lower bundle guide 91 is provided on either side thereof. Additionally, a center stapler unit UNI is provided at the same position as the jogger fences 250. The jogger fences 250 align the sheets in the sheet width direction perpendicular to the sheet conveyance direction, driven by a driving unit (not shown). The center stapler unit UNI includes two center staplers S2 each including a clincher unit and a driving unit. The center staplers S2 are arranged at a predetermined interval in the sheet width direction. It is to be noted that, although two fixed center staplers S2 each including the clincher unit and the driving unit are provided in the present embodiment, alternatively, a single center stapler may be moved to staple two positions.

Each of the pair of upper bundle rollers 71 and the pair of lower bundle rollers 72 includes a driving roller and a driven roller. Additionally, a detector to measure the distance (i.e., nip distance) between the upper bundle rollers 71 is provided. When the upper bundle rollers 71 clamp the bundle of sheets therebetween, the detector detects the nip distance between the upper bundle rollers 71 and transmits the nip distance to the CPU 3U. Thus, the CPU 3U can obtain the thickness of the bundle. The CPU 3U can select one of multiple operational modes, described below, according to the thickness of the bundle thus obtained.

The post-processing apparatus 3 further includes a movable back fence 73 disposed crossing the lower bundle guide 91. The movable back fence 73 can be moved by a driving unit via a timing belt in the sheet conveyance direction, which is vertical in FIG. 3. Although not shown, the driving unit to move the movable back fence 73 includes a driving pulley around which the timing belt is wound, a driven pulley, and a stepping motor to drive the driving pulley. Similarly, an aligning pawl 251 and a driving unit to drive it are provided on the side of an upper end of the upper bundle guide 92.

The driving unit moves the aligning pawl 251 via a timing belt 252 reciprocally in a direction away from the bundle guide unit including the lower and upper bundle guides 91 and 92 and the opposite direction to push the trailing end of the bundle (positioned on the upstream side when the bundle is introduced to the bundle guide unit).

The center-folding mechanism is positioned at a substantially center of the center-folding tray G and includes a folding plate 74, a pair of folding rollers 81, and the conveyance path H through which a bundle of folded sheets is transported.

Slots are formed in the folding plate 74 to engage two shafts projecting from front and back plates, respectively, and thus the folding plate 74 is supported by the shafts. Rotation of a driving unit is converted into a reciprocal linear movement by a link arm and a driving cam, and thus the folding plate 74 is moved. The folding plate 74 moves reciprocally between a home position outside a storage area of the center-folding tray G for storing the bundle and a position inside the storage area of the center-folding tray G to push the bundle into the nip between the folding rollers 81.

It is to be noted that, in FIG. 3, reference numeral 302 denotes an upper discharge detector to detect the sheet discharged to the upper tray 201, 303 denotes a shift discharge detector to detect the sheet discharged to the shift tray 203, 304 denote a sheet detector to detect the position of the sheet to be stored in the stack portion E, 305 denotes a sheet detector to detect sheet conveyance to the edge-stapling tray F, 310 denotes a sheet detector to detect whether any sheet is present on the edge-stapling tray F, 321 denotes a sheet detector to detect the sheet transported to the center-folding tray G, 322 denotes a fence HP detector to detect whether the movable back fence 73 is at the home position, and 326 denotes a pawl HP detector to detect whether the aligning pawl 251 is at the home position.

In the post-processing apparatus 3 according to the present embodiment, the sheet is discharged to the following destinations according to the post processing performed.

Mode 1 (no stapling): The sheets are transported through the conveyance paths A and B and discharged to the upper tray 201 without being stapled.

Mode 2 (no stapling): The sheets are transported through the conveyance paths A, C, I, and J, and then discharged to the shift tray 202 without being stapled.

Mode 3 (sorting): The sheets are transported through the conveyance paths A, C, I, and J, and then discharged to the shift tray 202. The shift tray 202 moves in the direction perpendicular to the sheet conveyance direction each time the last sheet in a set of output sheets is discharged thereto, thus sorting the sheets.

Mode 4 (stapling): The sheets are transported through the conveyance paths A and D to the processing tray F. After aligned and stapled on the processing tray F, the stapled sheets are transported through the conveyance path C to the shift tray 202.

Mode 5 (center stapling and bookbinding): The sheets are transported through the conveyance paths A and D to the processing tray F. After aligned and stapled along the centerline of the sheets on the processing tray F, the stapled sheets are folded in two along the centerline on the processing tray G, transported through the conveyance paths H and L, and then discharged to the downstream device by the discharge rollers 118.

Mode 6 (inserting sheets into envelopes): The sheets are transported through the conveyance path L, discharged to the insertion device 4, and inserted in the envelopes. How to process (e.g., whether to fold or not) sheets to be inserted in envelopes can be selected from: A) The sheets are transported to the conveyance path L after transported through the conveyance paths A, C, I, and K without stapling (no stapling); B) The sheets are transported through the conveyance paths A and D, aligned and stapled on the processing tray F, and transported through the conveyance path K; and C) The sheets are transported through the conveyance paths A and D, aligned and stapled along the centerline on the processing tray F, folded along the centerline on the processing tray G, and transported through the conveyance paths H.

Figure 4:
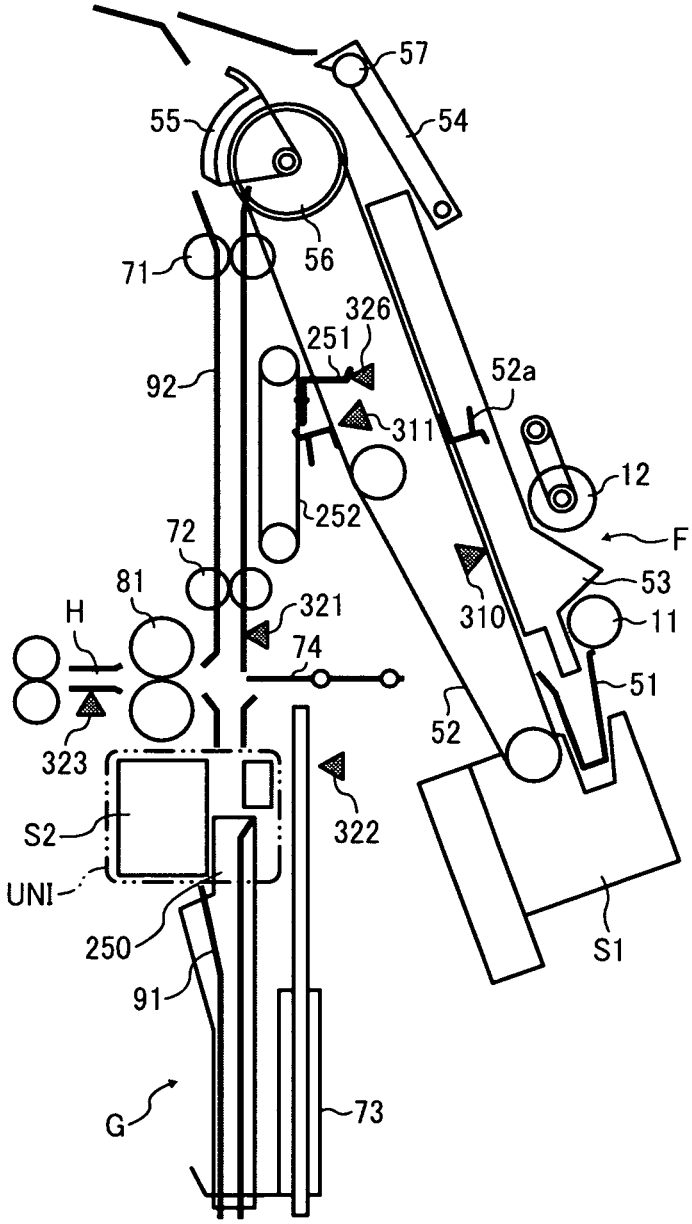
FIG. 4 is a front view of a mechanism for performing center folding included in the post-processing apparatus shown in FIG. 3.

FIGS. 4 through 12 illustrate processes performed in the mode 5 in which center stapling and bookbinding are executed. FIG. 4 is a front view illustrating states of the edge-stapling tray F and the center-folding tray G before stapling and folding.

Figure 5:
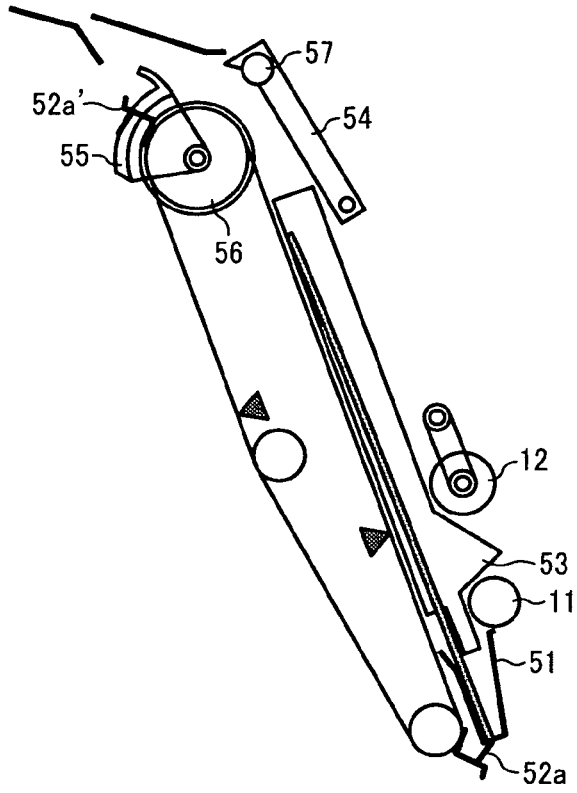
FIG. 5 illustrates a state in which a bundle of sheets is aligned on an edge-stapling tray.

Referring to FIG. 3, the sheet guided by the separation pawls 15 and 16 from the conveyance path A to the conveyance path D is transported to the edge-stapling tray F by the conveyance rollers 7, 9, and 10 and the discharge roller 11 shown in FIG. 4. The bundle of sheets guided to the edge-stapling tray F by the discharge rollers 11 are aligned similarly to the above-described mode 4. As shown in FIG. 5, the back fence 51 aligns the bundle of sheets.

Figure 6:
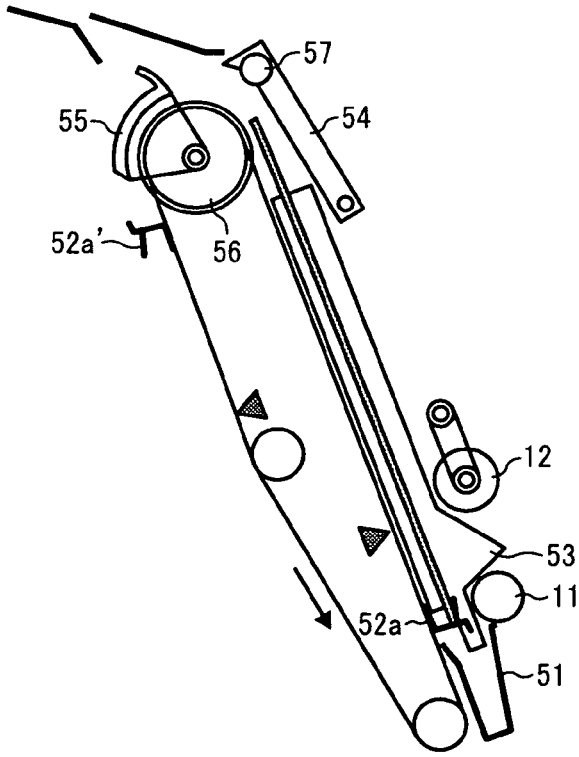
FIG. 6 illustrates a state subsequent to that shown in FIG. 5, in which the bundle of sheets is pushed up by a release pawl from the edge-stapling tray.
Figure 7:
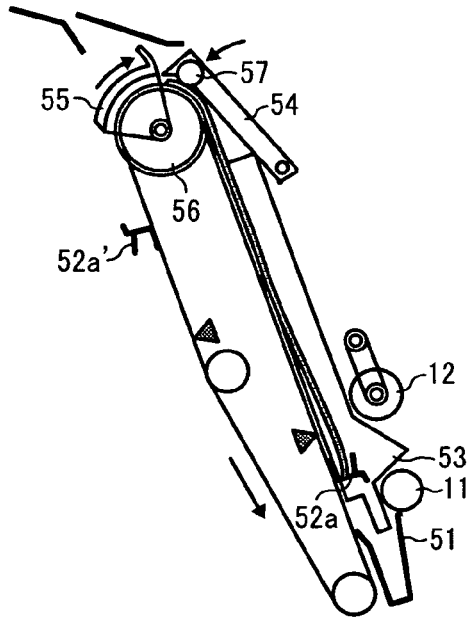
FIG. 7 illustrates a state subsequent to that shown in FIG. 6, in which the bundle is being forwarded to a center-folding tray.
Figure 8:
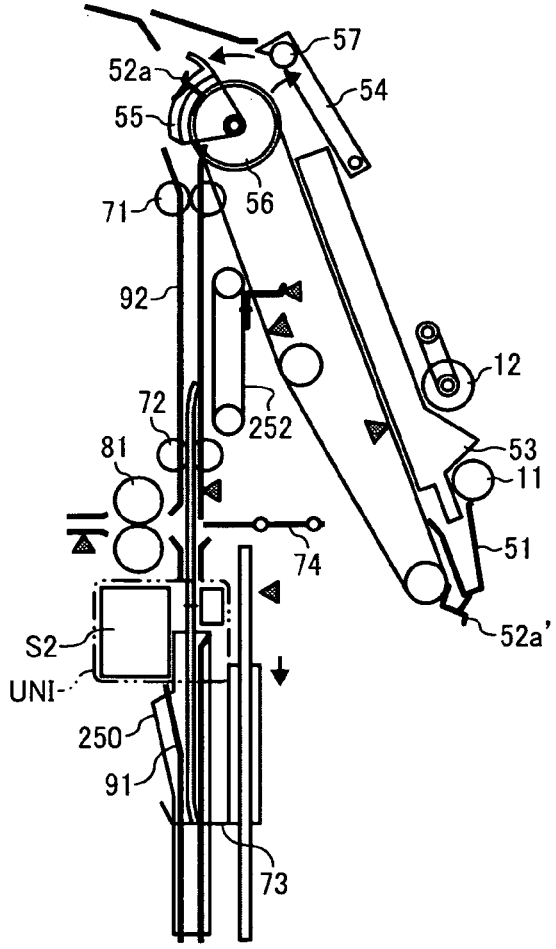
FIG. 8 illustrates the bundle on the center-folding tray.

After the bundle of sheets is roughly aligned on the edge-stapling tray F, the release pawl 52*a* lifts the bundle as shown in FIG. 6. Then, the release roller 56 and the pressure roller 57 clamp a leading-edge portion of the bundle therebetween as shown in FIG. 7. Subsequently, the bifurcation guide 54 as well as the movable guide 55 rotates, thus forming the route to the center-folding tray G as described above. The bundle of sheets is transported further by the release pawl 52*a* and the release roller 56 through this route to the center-folding tray G. The release roller 56 is provided at the driving shaft of the release belt 52 and driven in synchronization with the release belt 52.

Figure 9:
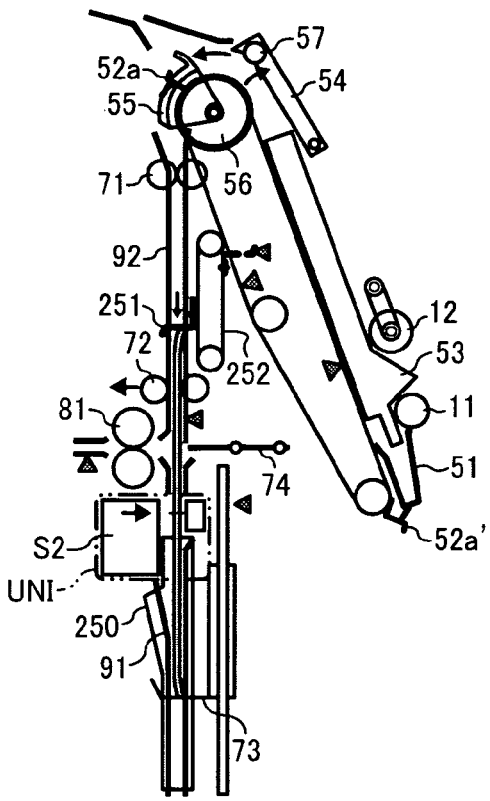
FIG. 9 illustrates a state subsequent to that shown in FIG. 8, in which the bundle is being stapled on the center-folding tray.

Subsequently, the release pawls 52*a* transport the bundle until the trailing edge of the bundle passes by the release roller 56. Further, the upper bundle conveyance rollers 71 and the lower bundle conveyance rollers 72 transport the bundle to the position shown in FIG. 8. The position of the back fence 73 is set at one of multiple different positions according to the sheet size in the sheet conveyance direction, and the back fence 73 waits for the bundle at the position corresponding to the sheet size. When the leading edge of the bundle comes into contact with the back fence 73 on standby, as shown in FIG. 9, the lower bundle conveyance rollers 72 are disengaged from each other. Then, the aligning pawl 251 pushes the trailing edge of the bundle, and thus the bundle of sheets is fully aligned in the sheet conveyance direction. Further, the sheets are aligned in the sheet width direction by the jogger fences 250 positioned beneath the center stapler unit UNI in FIG. 9. Thus, the sheets are aligned in the sheet width direction by the jogger fences 250 and in the sheet conveyance direction (longitudinal direction of sheets) by the back fence 73 and the aligning pawl 251.

At that time, the amounts by which the back fence 73 (stopper) and the pair of jogger fences 250 push the bundle of sheets to align it are set to optimum values according to the sheet size, the number of sheets, and the thickness of the bundle. It is to be noted that, when the bundle of sheets is relatively thick, it occupies a larger area in the conveyance path with the remaining space therein reduced, and accordingly a single alignment operation is often insufficient to align it. In this case, the number of times the alignment operation is repeated is increased to align the sheets neatly.

Additionally, as the number of sheets increases, it takes longer to stack multiple sheets one on another on the upstream side, and accordingly it takes longer before the processing tray G receives a subsequent bundle of sheets. Consequently, the increase in the number of times the alignment operation is performed does not cause a loss time in the sheet processing system, and thus streamlined, reliable alignment can be attained. As described above, the sheets can be processed efficiently by adjusting the number of times the alignment operation is performed according to the time required for the processing on the upstream side.

Subsequently, the center stapler S2 staples the bundle of sheets along its centerline as shown in FIG. 9. Accordingly, the back fence 73 sets the bundle of sheets such a position that the center stapler S2 can staple a center portion of the bundle. It is to be noted that the positions of the movable back fence 73 and the aligning pawl 251 are determined by the number of pulses of the fence HP detectors 322 and that of the pawl HP detector 326, respectively.

Figure 10:
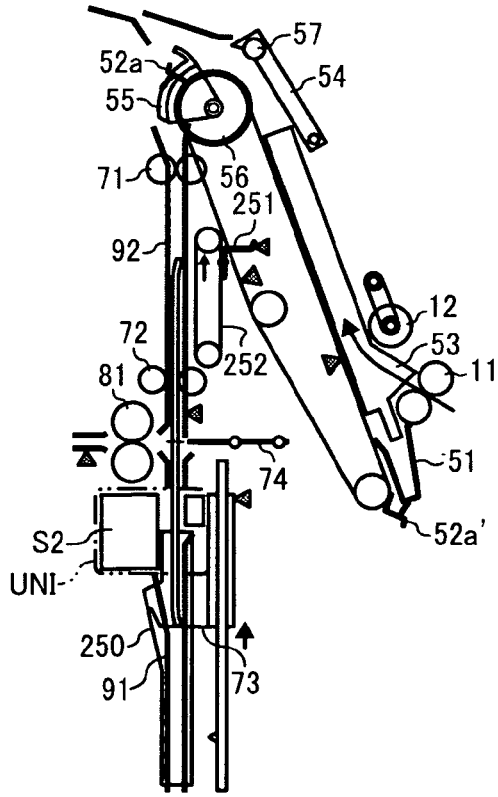
FIG. 10 illustrates a state subsequent to that shown in FIG. 9, in which the bundle is positioned with the center portion of the bundle facing a folding plate.
Figure 11:
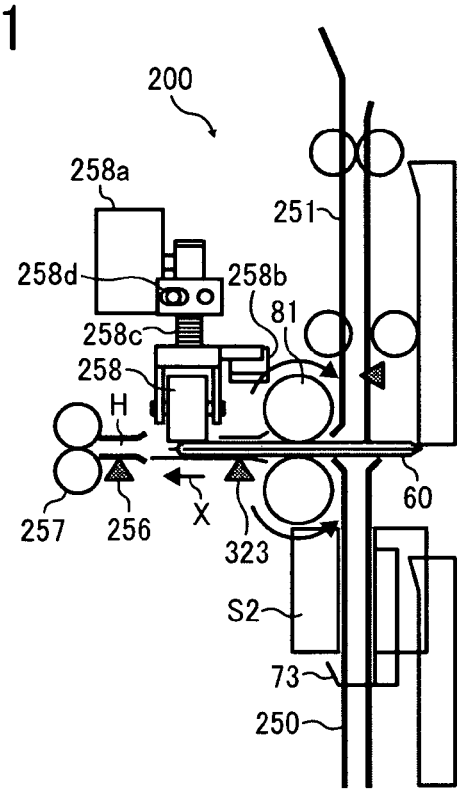
FIG. 11 illustrates a state subsequent to that shown in FIG. 10, in which the bundle is additionally squeezed by a squeezing unit.

As shown in FIG. 10, after stapled along the centerline, the bundle is not clamped by the lower bundle conveyance rollers 72 but is transported upward as the back fence 73 moves. The bundle is stopped at the position where the center portion of the bundle to be folded faces the edge of the folding plate 74. Subsequently, as shown in FIGS. 10 and 11, the folding plate 74 pushes the portion adjacent to the staple binding the sheets in a direction substantially perpendicular to the surface of the sheets into the nip between the folding rollers 81 positioned facing the folding plate 74. The folding rollers 81, which start rotating in advance, transport the bundle while pressing the bundle. Thus, the bundle is folded in two along the centerline.

Figure 12:
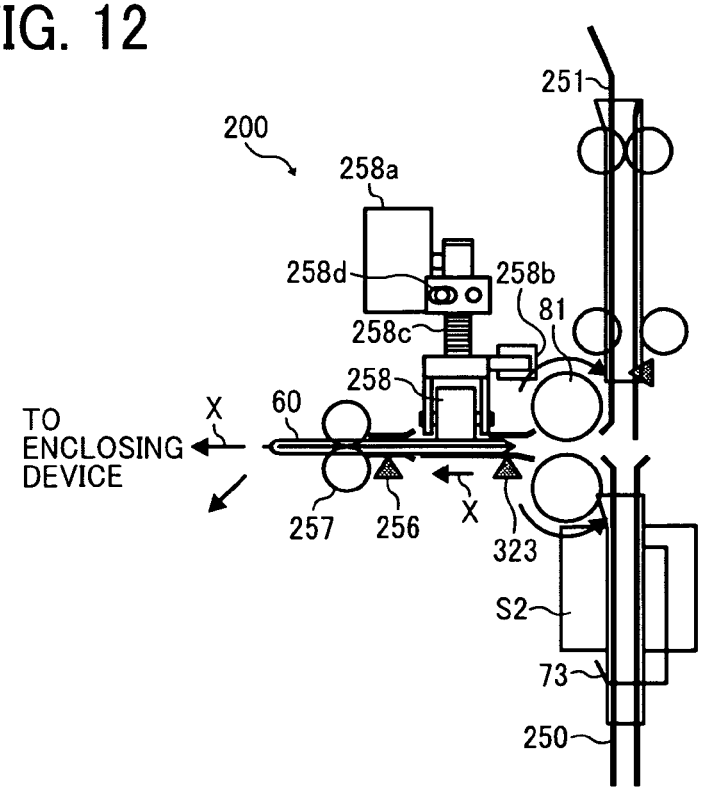
FIG. 12 illustrates the bundle discharged after folded in two and squeezed.

FIGS. 11 and 12 illustrate a squeezing unit 200 to further squeeze the folded sheets, provided along the conveyance path H shown in FIG. 3. It is to be noted that, in FIGS. 11 and 12, reference numeral 60 represents the bundle of center-folded sheets. If necessary, the bundle 60 is further folded after pressed and transported by the folding rollers 81. That is, the bundle 60 is further squeezed by a pressure roller 258 (hereinafter "additional squeezing") to strengthen the folded line of the bundle 60 or to make the bundle 60 thinner as shown in FIG. 11.

Because the direction in which the bundle of sheets is transported after stapling along centerline is upward, the bundle can be transported reliably by the back fence 73 only. If the device is configured so that the bundle to be folded is transported down, the bundle might fail to follow the downward movement of the back fence 73 because of effects of friction and static electricity. Thus, reliable conveyance of the bundle cannot be secured. Therefore, such a configuration in which the bundle to be folded is transported down requires another conveyance member such as a conveyance roller and becomes more complicated.

Referring to FIGS. 11 and 12, descriptions are given below of a configuration and operation of the squeezing unit 200 provided along the conveyance path H shown in FIG. 3.

The squeezing unit 200 additionally squeezes the folded portion of the bundle of center-folded sheets 60 folded in the post-processing apparatus 3 to make it thinner. Referring to FIGS. 11 and 12, the squeezing unit 200 may has a known configuration and, in the present embodiment, includes a pressure roller 258, a driving motor 258*a* to move the pressure roller 258, a guide 258*b* extending in the direction perpendicular to the sheet conveyance direction, to guide a holder of the pressure roller 258 movably, vertically in FIGS. 11 and 12, a support shaft 258*c* to apply pressure to the pressure roller 258 with a compression spring, and a bracket 258*d* to support the pressure roller 258. The bracket 258*d* is supported slidably on a guide rail extending in the direction perpendicular to the sheet conveyance direction. The support shaft 258*c* connects the holder of the pressure roller 258 to the bracket 258*d* in such a way that the holder can move vertically relative to the bracket 258*d*. Additionally, a folded portion detector 323 to detect the leading-edge portion of the bundle 60 is provided downstream from the folding rollers 81 and upstream from the pressure roller 258.

FIG. 11 illustrates a state in which the pressure roller 258 of the squeezing unit 200 squeezes the folded portion of the bundle 60 after the folding rollers 81 fold the sheets in two, and FIG. 12 illustrates a state in which the bundle 60 is discharged from the squeezing unit 200 after squeezed by it.

In FIGS. 11 and 12, the pressure roller 258 is positioned adjacent and downstream from the folding rollers 81 in the sheet conveyance direction and rolls in the direction perpendicular to the sheet conveyance direction. As shown in FIG. 11, after folded along its centerline by the folding rollers 81, the bundle 60 is further transported in the direction indicated by arrow X shown in FIG. 11. The bundle 60 is transported a predetermined distance (predetermined conveyance distance) after the leading-edge portion of the bundle 60 passes by the folded portion detector 323 and stopped at a position where the leading-edge portion of the bundle 60 is pressed by the pressure roller 258. When a stepping motor is used as the conveyance motor, this distance can be controlled by the number of pulses of the stepping motor. It is to be noted that the predetermined conveyance distance by which the bundle 60 is transported from the folded portion detector 323 can be controlled in other ways, without using the step number of the stepping motor, and the conveyance motor is not limited to the stepping motor. The pressure roller 258 rolls on and squeezes the folded portion (i.e., leading-edge portion) of the bundle 60 in the direction perpendicular to the sheet conveyance direction. Accordingly, the leading-edge portion of the bundle 60 is stopped at a position on the route of the pressure roller 258.

An initial position of the pressure roller 258 is outside a bundle conveyance area in which the bundle 60 is transported, and the bundle 60 is stopped when the leading-edge portion of the bundle 60 reaches the position shown in FIG. 11. With the bundle retained at that position, the driving motor 258*a* rotates, causing via a transmission unit the bracket 258*d* to slide on the guide rail reciprocally in the direction perpendicular to the sheet conveyance direction to squeeze the leading-edge portion of the bundle 60 along the folded lines. Thus, the folded portion of the bundle 60 is further squeezed, strengthening the folded lines and flattening the bundle 60. After the additional squeezing by the squeezing unit 200 is completed and the pressure roller 258 returns to the initial position, outside the bundle conveyance area, the folding rollers 81 resume transporting the bundle 60. Then, as sown in FIG. 12, the bundle 60 passes by the sheet detector 256, is further transported in the direction indicated by arrow X shown in FIG. 12 by the conveyance rollers 257, and then discharged by the discharge rollers 118 shown in FIG. 3 to the downstream device, that is, the insertion device 4.

When the folded portion detector 323 detects a trailing-edge portion of the bundle 60, both the folding plate 74 and the back fence 73 return to the respective home positions. Then, the lower bundle conveyance rollers 72 move to press against each other as a preparation for receiving a subsequent bundle of sheets. Further, if the number and the size of sheets forming the subsequent bundle are similar to those of the previous bundle of sheets, the back fence 73 may move again to the position shown in FIG. 8 and wait there.

It is to be noted that, although the post-processing apparatus 3 shown in FIGS. 3 through 12 has a capability of center folding (i.e., folding sheets in two), known folding devices capable of folding sheets in two, three, or four; folding sheets into Z-like shape, double door-like shape, accordion-like shape; or at least two of them may be used. Those configurations are disclosed in JP-200967537, which is incorporated by reference herein in its entirety.

Figure 13:
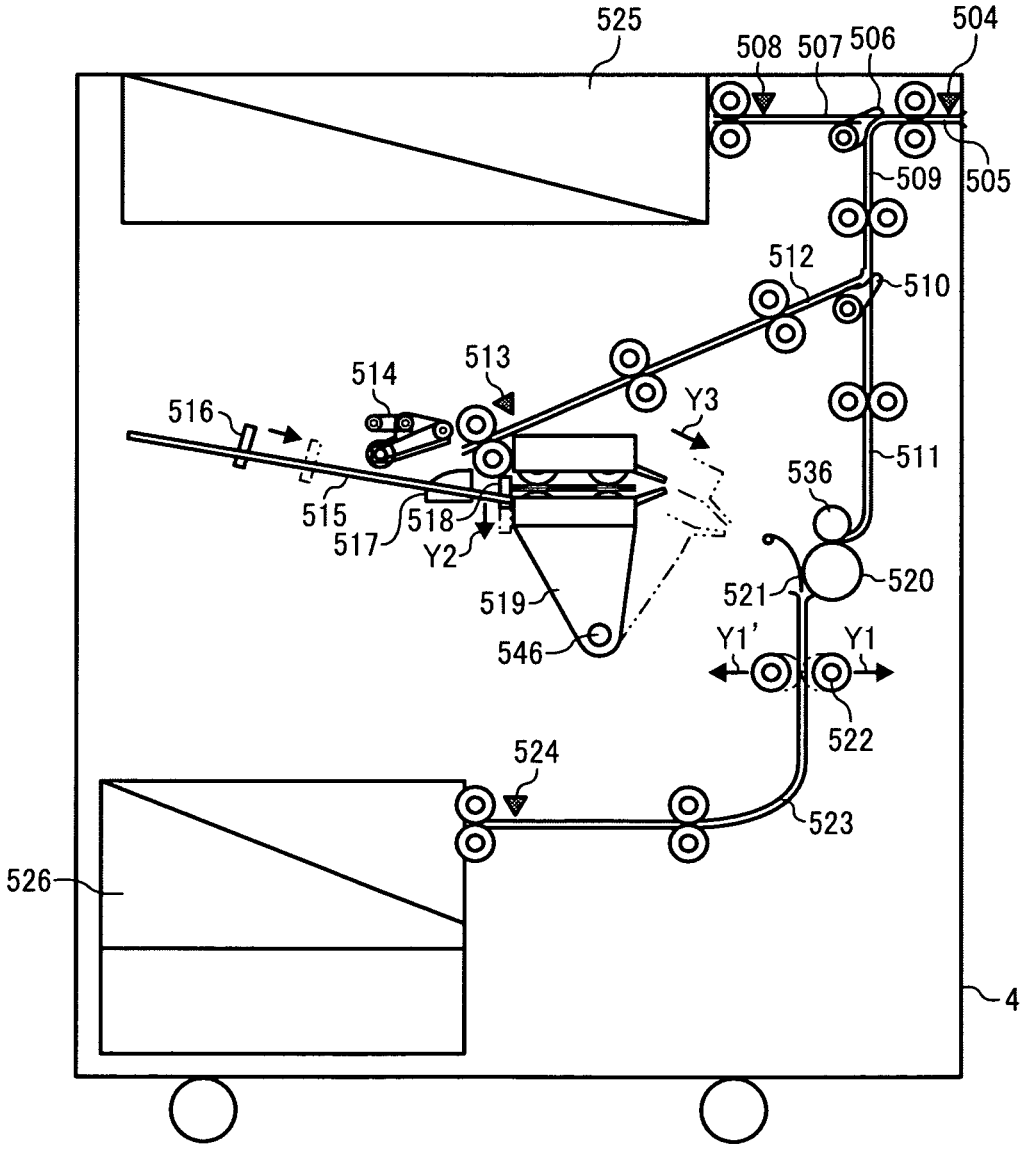
FIG. 13 illustrates an interior of an insertion device according to an embodiment.

FIG. 13 illustrates an interior of the insertion device 4 according to the present embodiment.

The envelopes stored in the feed cassette 1-B of the image forming apparatus 1 are fed to an image forming unit inside the image forming apparatus 1, and the image forming unit prints addresses on the envelopes, after which the envelopes are transported to the post-processing apparatus 3 and further to the insertion device 4. The envelope enters an entrance path 505 leading from an entrance of the insertion device 4, and an entry detector 504 detects the envelope. Then, the respective conveyance rollers are driven and start transporting the envelope. A pivotable upper separation pawl 506 is provided at a bifurcation position from which the entrance path 505 bifurcates into an upper conveyance path 507 on the side of an upper discharge tray 525 and a lower conveyance path 509.

In FIG. 13, the upper separation pawl 506 pivots to an upper position and guides the envelope to the lower conveyance path 509. Additionally, a pivotable lower separation pawl 510 is provided at a bifurcation position from the lower conveyance path 509 between a vertical conveyance path 511 and an enclosure conveyance path 512. To guide the envelope, the lower separation pawl 510 pivots counterclockwise in FIG. 13 to a position to open the vertical conveyance path 511. Thus, the envelope is guided to the vertical conveyance path 511. A pair of chuck rollers, namely, a lower chuck roller 520 and an upper chuck roller 536, is provided extreme downstream in the vertical conveyance path 511, and an unsealing sheet 521 is partially in contact with a part of the lower chuck roller 520. Further, a pair of pivotable rollers 522 is provided downstream from the unsealing sheet 521. The upper and lower chuck rollers 536 and 520 clamp a gusset portion of the envelope, retaining the envelope there, and wait for the enclosure. At this time, the pivotable rollers 522 are withdrawn from the envelope in the directions indicated by arrows Y1 and Y1', respectively, not to contact the envelope.

In the image forming apparatus 1, an image reading unit reads image data of an original document sent by the ADF 2, and then a sheet sized corresponding to the size of the original document is fed from the feed cassette 1-B to the MFP. After an image is formed on the sheet, the sheet is transported to the post-processing apparatus 3. The sheet to be inserted in the envelope (i.e., enclosure) is folded or stapled, or folded and stapled as required in the post-processing apparatus 3, after which the sheet is transported to the insertion device 4. When neither folded nor stapled, the enclosure is transported through the conveyance paths A, C, I, K, and L in the post-processing apparatus 3 to the entrance path 505 of the insertion device 4. After the entry detector 504 detects the enclosure, the conveyance rollers are driven and start transporting the enclosure.

The upper separation pawl 506 pivots to the upper position, thus guiding the enclosure to the lower conveyance path 509. The lower separation pawl 510 pivots to the position shown in FIG. 13, thus guiding the enclosure to the enclosure conveyance path 512. The enclosure passes by an enclosure detector 513 and is stacked on an intermediate tray 515. Subsequently, a return roller 514 moves to a position in contact with the intermediate tray 515 and transports the enclosure toward a back stopper 518. Further, a pair of side joggers 517 aligns the enclosure. This operation is repeated until all the enclosures are aligned on the intermediate tray 515.

After a bundle of enclosures are stacked on the intermediate tray 515, the back stopper 518 is withdrawn in the direction indicated by arrow Y2. A front stopper 516 starts moving in the direction indicated by arrow shown in FIG. 13 to a position indicated by broken lines and transports the bundle of enclosures inside a pack unit 519. Then, the bundle of enclosures is clamped in nips between upper rollers 542 and lower rollers 543, arranged vertically (shown in FIG. 21), in the pack unit 519. After the enclosures are transported therein, the pack unit 519 pivots about a support point 546 in the direction indicated by arrow Y3 shown in FIG. 13. Then, a single enclosure or multiple enclosures to be inserted in a single envelope are transported by the upper rollers 542 and the lower rollers 543 of the pack unit 519 into the envelope retained by the pair of chuck rollers 520 and 536. After the enclosures are put in the envelope, the pivotable rollers 522 move in the direction opposite to the directions indicated by arrows Y1 and Y1', respectively, and start transporting the envelope to a discharge path 523. The envelope is transported through the discharge path 523, passes by an envelope detector 524, and is stacked on an envelope tray 526.

It is to be noted that, when the upper separation pawl 506 pivots clockwise from the position shown in FIG. 13 to a position to open the upper conveyance path 507, the envelope or the sheet is discharged from the upper conveyance path 507 to the upper discharge tray 525. It is to be noted that, in FIG. 13, reference numeral 508 denotes a discharge detector to detect the object to be discharged to the upper discharge tray 525.

Figure 14:
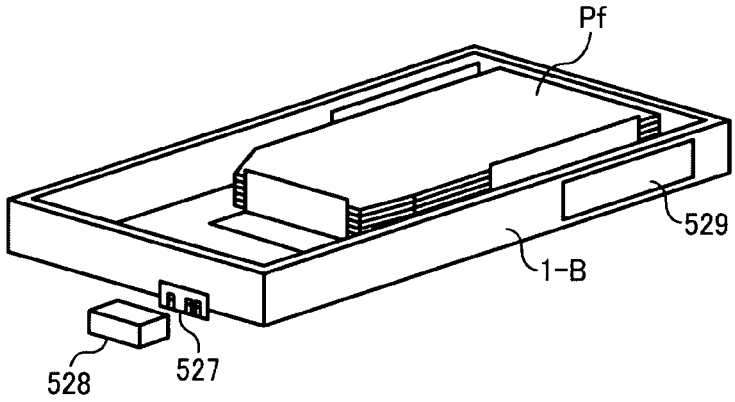
FIG. 14 is a perspective view that illustrates a feed cassette of an image forming apparatus and a size detecting system to detect the size of the envelope or enclosure stored in the feed cassette.

FIG. 14 is a perspective view that illustrates the feed cassette 1-B of the image forming apparatus 1 and a size detecting system to detect the size of the envelope or enclosure stored in the feed cassette 1-B.

In FIG. 14, a planar size indicator 527 is attached to each feed cassette 1-B. Each size indicator 527 is sized according to the size of the sheets or envelopes contained therein. The main body of the image forming apparatus 1 includes a size detector 528 corresponding to each size indicator 527. When the feed cassette 1-B is set in the main body, the size detector 528 detects the size indicator 527 and thus recognizes the size of the sheets or envelopes (in FIG. 14, envelopes Pf) contained in the feed cassette 1-B. Additionally, a size sticker 529 (i.e., size label) is stuck to side face of the feed cassette 1-B so that the user can recognize the size or type of the objects contained therein.

Figure 15:
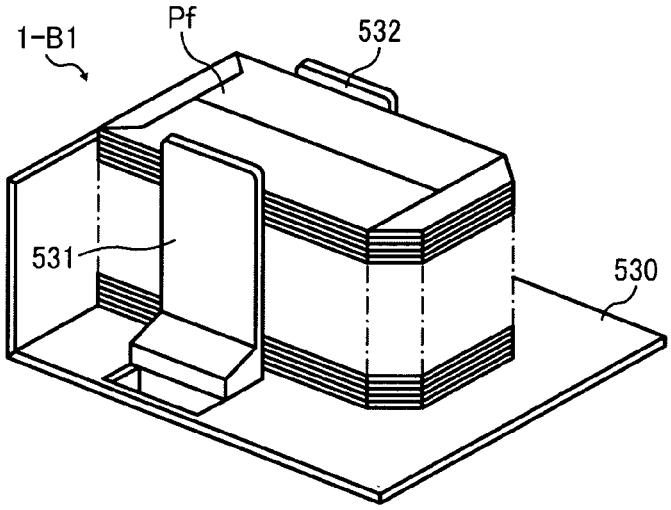
FIG. 15 is a perspective view that illustrates a variation of the feed cassette and the size detecting system.
Figure 16:
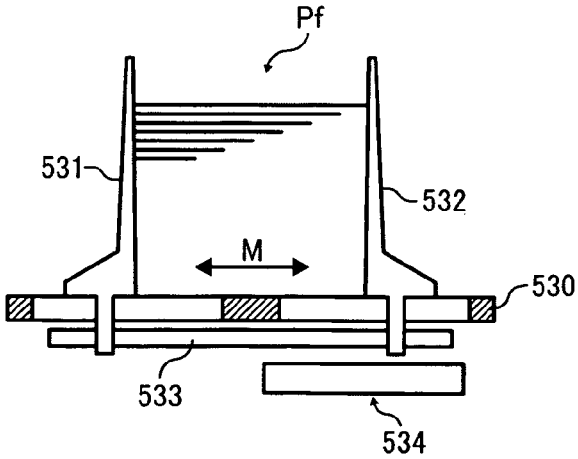
FIG. 16 is a cross-sectional view of the feed cassette and the size detecting system shown in FIG. 15.

FIG. 15 is a perspective view that illustrates a variation of the feed cassette 1-B of the image forming apparatus 1 and the size detecting system to detect the size of the envelope or enclosure stored therein. FIG. 16 is a cross-sectional view of the feed cassette and the size detecting system shown in FIG. 15.

A feed cassette 1-B1 shown in FIGS. 15 and 16 includes a bottom plate 530 on which the envelopes Pf are stacked and a pair of side guides 531 and 532 slidable in a direction indicated by arrow M shown in FIG. 16, along a guide rod 533. The envelopes Pf are set in a center portion of the bottom plate 530, pushed by the side plates 531 and 532. Additionally, a size detector 534 is provided beneath the bottom plate 534. The size detector 534 detects the position of the side guide 532 to detect the size of the objects (in FIGS. 15 and 16, envelopes Pf) stacked on the bottom plate 530. More specifically, the size detector 534 compares the detected position of the side guide 532 with size data stored preliminarily therein and thus recognizes the size of the sheets or the envelopes Pf set on the bottom plate 530. For example, a variable-resistance position detector can be used as the size detector 534. The CPU 1U can easily detect the size of the objects contained in the sheet cassette 1-B1 based on the resistance output by the variable-resistance type position detector or changes in the resistance.

Figure 17:
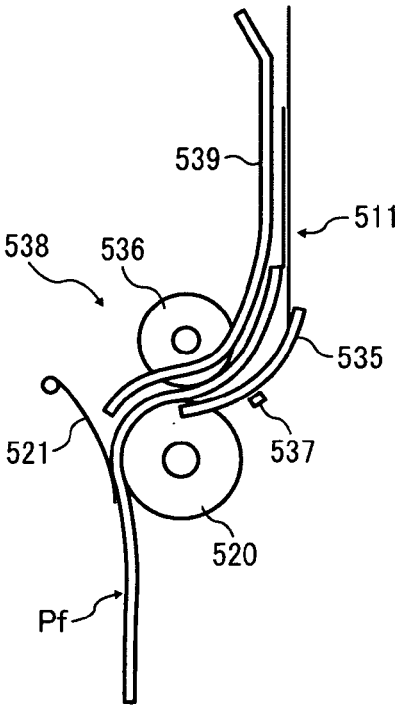
FIG. 17 is a cross-sectional view that illustrates a main portion of an envelope chuck unit in the insertion device.

FIG. 17 is a cross-sectional view that illustrates a main portion of an envelope chuck unit in the insertion device 4.

In FIG. 17, the lower chuck roller 520 and the upper chuck roller 536, provided extreme downstream in the vertical conveyance path 511, together form an envelope chuck unit 538. The chuck rollers 520 and 536 are arranged substantially vertically in FIG. 17 and can rotate while pressing against each other, forming a nip portion therebetween. The chuck rollers 520 and 536 may be rollers, cones, or spheres. Envelope guides 535 and 539 to guide the envelope Pf to the nip portion between the chuck rollers 520 and 536 are provided upstream from the chuck rollers 520 and 536 in the vertical conveyance path 511 in the direction in which the envelope is transported (hereinafter "envelope conveyance direction"). An envelope detector 537 is provided on an upstream side of the nip portion in the envelope conveyance direction. The unsealing sheet 521 in contact with the lower chuck roller 520 is formed of a plastic sheet such as Mylar and can deform elastically. The unsealing sheet 521 is provided at such a position that a part of the unsealing sheet 521 can enter an opening Pon (shown in FIG. 18) of the envelope Pf supported by the chuck rollers 520 and 536, thereby unsealing the envelope Pf.

The envelope guides 535 and 539 guide the envelope Pf from the vertical conveyance path 511 to the nip portion between the chuck rollers 520 and 536 and further downward from the nip portion between the chuck rollers 520 and 536 along a circumferential surface of the lower chuck roller 520.

The unsealing sheet 521 may be a thin resin film member and positioned adjacent to the lower chuck roller 520. An upper side of the unsealing sheet 521 is fixed, and, in an ordinary state, a portion of the unsealing sheet 521 adjacent to a lower end portion 521*a* (shown in FIG. 18) thereof is pressed against the lower chuck roller 520 with a predetermined pressure due to the elasticity of the material of the unsealing sheet 521.

Figure 18:
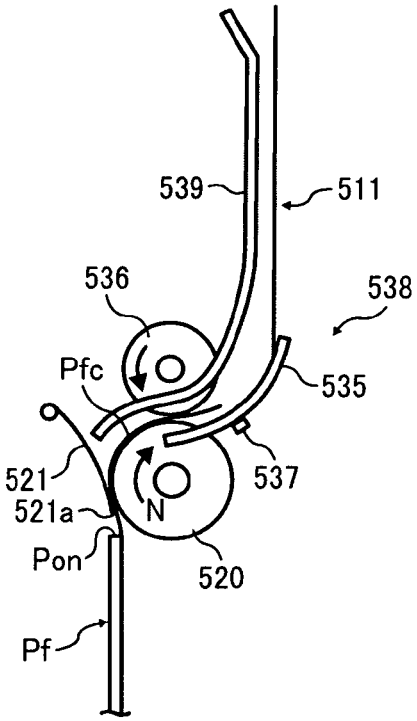
FIG. 18 is a cross-sectional view that illustrates the main portion of the envelope chuck unit, in which an opening of the envelope is positioned beneath a lower end of an unsealing sheet.
Figure 19:
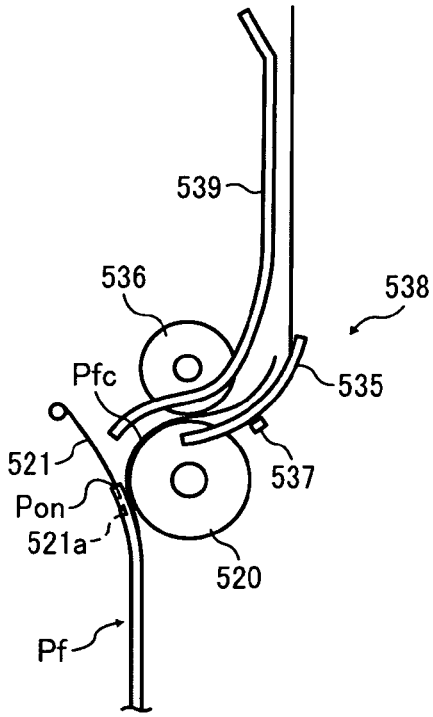
FIG. 19 is a cross-sectional view that illustrates the main portion of the envelope chuck unit, in which the lower end of the unsealing sheet is in the envelope.

FIG. 18 is a cross-sectional view of the main portion of the envelope chuck unit 538 and illustrates a state in which the opening Pon of the envelope Pf is positioned beneath the lower end portion 521*a* of the unsealing sheet 521. FIG. 19 is another cross-sectional view of the main portion of the envelope chuck unit 538, and the lower end portion 521*a* of the unsealing sheet 521 is in the envelope Pf in FIG. 19.

In the envelope chuck unit 538, the envelope guides 535 and 539 guide the envelope Pf to the nip portion between the chuck rollers 520 and 536 when the envelope Pf is transported downward in FIG. 18. Subsequently, the chuck rollers 520 and 536 rotate and transport the envelope Pf between the chuck roller 520 and the unsealing sheet 521. When the sheet or enclosure is guided into the envelope Pf, the envelope Pf is stopped at such a position that a flap Pfc of the envelope Pf is clamped by the chuck rollers 520 and 536 as shown in FIG. 18. More specifically, when the envelope detector 537 detects passage of an end of the flap Pfc of the envelope Pf, the CPU 4U stops a driving motor that drives the chuck rollers 520 and 536, thus stopping the envelope Pf. At that time, the opening Pon of the envelope Pf is positioned lower than the lower end portion 521*a* of the unsealing sheet 521.

Subsequently, the CPU 4U rotates the chuck rollers 520 and 536 in reverse, which is the direction indicated by arrow N shown in FIG. 18. Thus, the envelope Pf is switchbacked and transported upward in the vertical conveyance path 511. At that time, because the lower side of the unsealing sheet 521 is in contact with the flap Pfc of the envelope Pf due to its elasticity, the lower end portion 521*a* of it enters the opening Pon of the envelope Pf as shown in FIG. 19. The reverse rotation of the chuck rollers 520 and 536 is stopped in this state, and upward conveyance of the envelope Pf is stopped.

Figure 20:
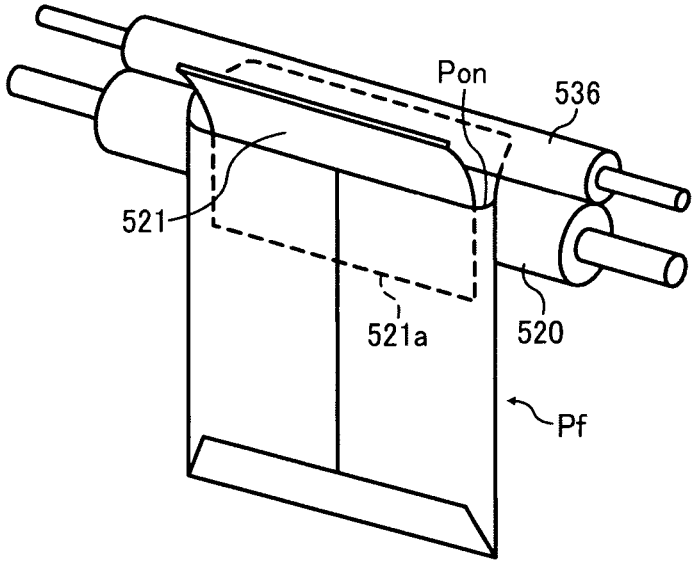
FIG. 20 is a perspective view that illustrates a state in which reverse rotation of chuck rollers is stopped, thereby stopping the envelope.
Figure 21:
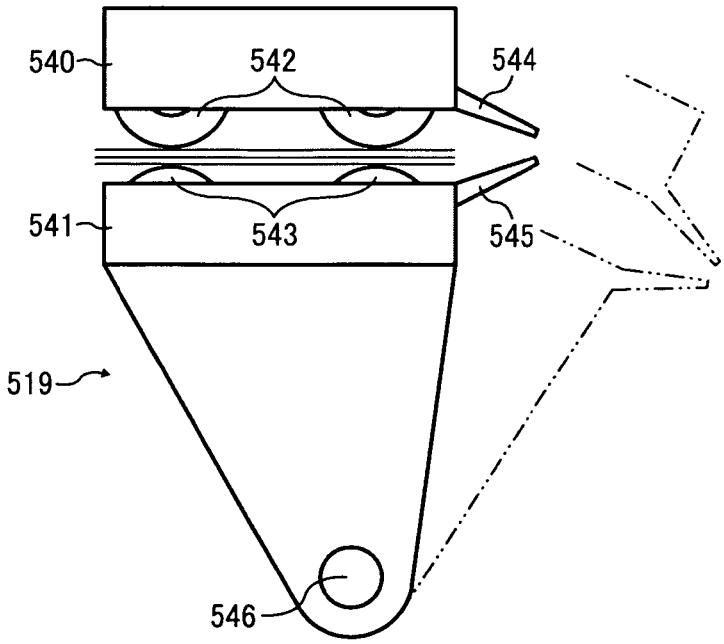
FIG. 21 is a front view of a pack unit of the insertion device.

FIG. 20 is a perspective view illustrating this state, and the envelope Pf is opened by the lower end portion 521*a* of the unsealing sheet 521 that is in the opening Pon of the envelope Pf. FIG. 21 is a front view of the pack unit 519 of the insertion device 4.

In the configuration shown in FIG. 21, the pack unit 519 includes an upper pack portion 540 and a lower pack portion 541, and the upper rollers 542 and the lower rollers 543 are rotatively attached to the upper pack portion 540 and a lower pack portion 541, respectively. Additionally, entry guides 544 and 545 are respectively provided on the right end sides of the upper pack portion 540 and the lower pack portion 541 in FIG. 21. Base ends (proximal ends) of the entry guides 544 and 545 are rotatively supported by the upper pack portion 540 and the lower pack portion 541, respectively, and dismal end sides of the entry guides 544 and 545 are biased toward each other by springs with a relatively small pressure, respectively. With this configuration, when a bundle of enclosures passes between the entry guides 544 and 545, the entry guides 544 and 545 are pushed away from each other. Thus, the resistance that the bundle of enclosures receives can be lower when the bundle is transported.

The pack unit 519 pivots about the support point 546 supporting the pack unit 519, and the entry guides 544 and 545 are inserted between the flap Pfc and the unsealing sheet 521, which is on standby at the position shown in FIG. 20. In this state, the front stopper 516 moves in the direction indicated by arrow shown in FIG. 13 as described above, and the upper and lower rollers 542 and 543 are driven. Then, the enclosure passes between the entry guides 544 and 545 and is inserted in the envelope Pf.

Figure 22:
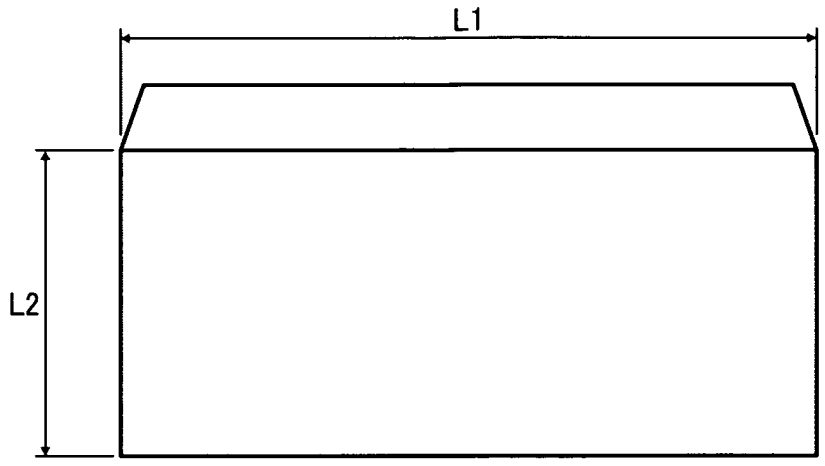
FIG. 22 illustrates an envelope.

FIG. 22 is a diagram of the envelope Pf.

In FIG. 22, reference characters L1 and L2 represent a length (width) of an opening of the envelope Pf (hereinafter "opening length") and a depth of the envelope Pf, respectively. The opening length L1 may be equivalent to the width of the envelope Pf. The envelope size is determined by the opening length L1 and the depth L2.

Figure 23:
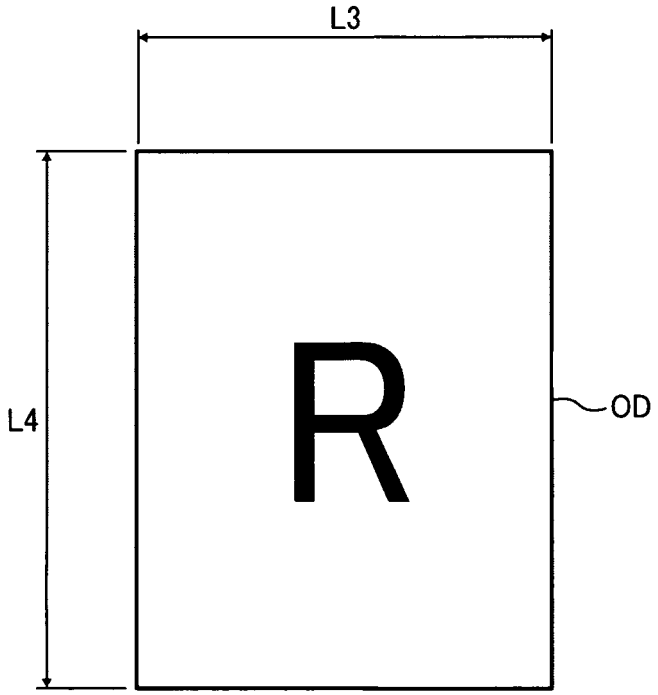
FIG. 23 illustrates an original document.

FIG. 23 is a diagram of an original document OD.

In FIG. 23, reference characters L3 and L4 represent a length in a sub-scanning direction and a length in a main scanning direction of the original document OD. The original document size is determined by the lengths L3 and L4.

Figure 24:
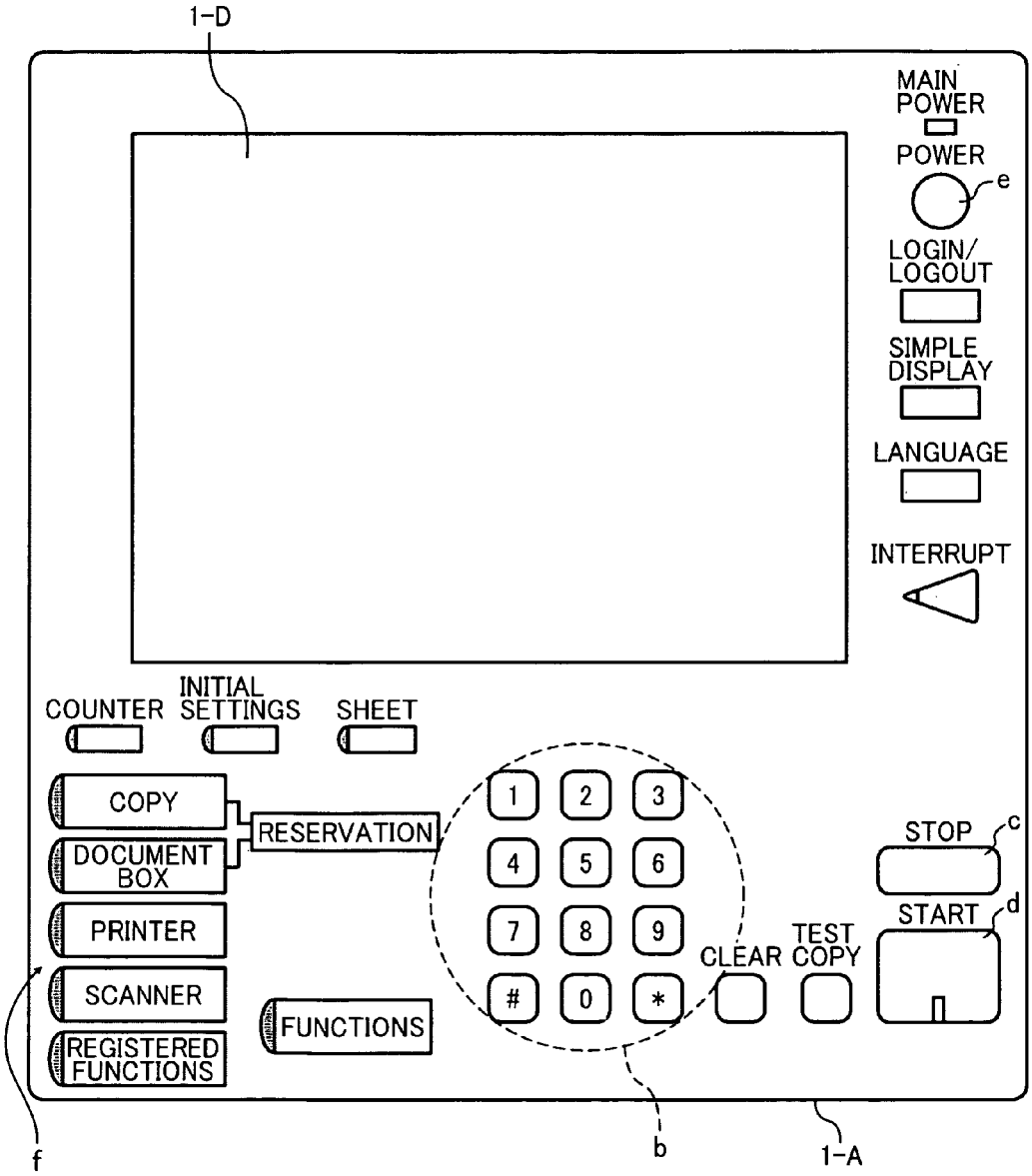
FIG. 24 illustrates an operation panel.

FIG. 24 is a front view of the operation panel 1-A provided on an upper face of the image forming apparatus 1.

Referring to FIG. 24, the operation panel 1-A includes the display 1-D, a group of numeric keys b, a STOP key c, a START key d, a POWER button e, and a group of function selection keys f. The display 1-D displays various messages and input keys in layers. The user can input numbers by pressing the numeric keys b. The user can stop processing by pressing the STOP key c. Pressing the START key d generates a trigger signal to start image formation. The user can turn on and off the image forming system by pressing the POWER button e. The group of function selection keys f includes keys with which the user selects copying, printing, scanning, or the like.

Figure 25:
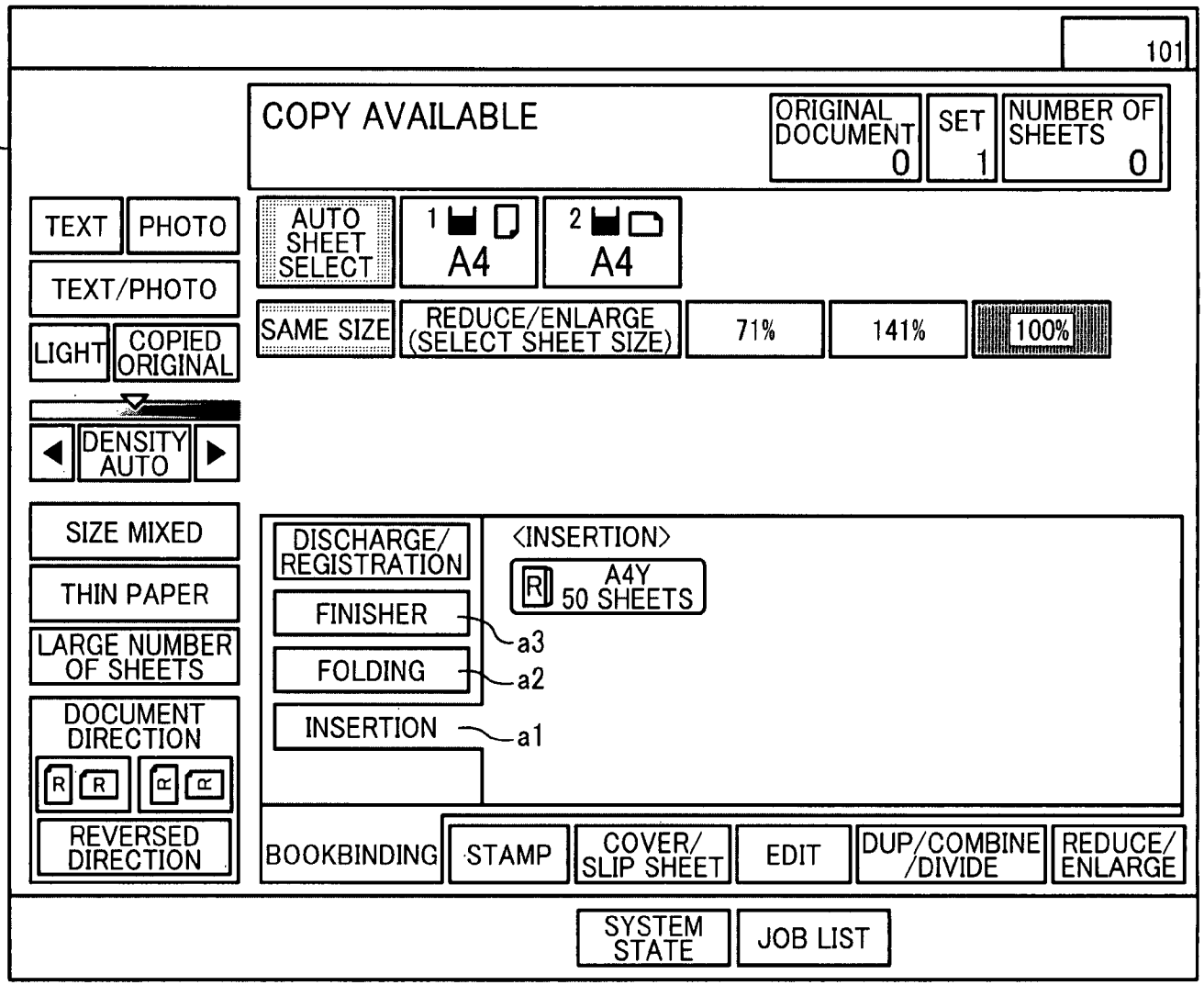
FIG. 25 illustrates indications on a display of the operation panel shown in FIG. 24.

FIG. 25 illustrates indications on the display 1-D of the operation panel 1-A shown in FIG. 24.

The indications shown in FIG. 25 appear when A4 size sheets are stored laterally in the first feed cassette 1-B Y (hereinafter "A4Y sheets") and A4 size sheets are stored lengthwise in the second feed cassette 1-B Y (hereinafter "A4T sheets").

It is to be noted that, in the configuration shown in FIG. 25, the size of the original document is A4 size, and the same sized sheets are set laterally in one of the feed cassettes 1-B and lengthwise in the other.

To insert the sheet into the envelope, the user presses an INSERTION button a1 of an insertion tab on the display 1-D shown in FIG. 25, sets the original document in the ADF 2, and presses the START key d on the operation panel 1-A. Then, the envelope is fed from the feed cassette 1-B. The sheet is fed from the first or second feed cassette 1-B, and an image is formed on the sheet according to the image data of the original document. Although copying the original document is performed here as an example, alternatively, image data transmitted from, for example, computers, can be printed on the sheet in a manner similar to copying. To fold the sheet, the user presses a FOLDING button a2 and set the type of folding (i.e., folding style), for example, folding it in two or three. To staple the sheet, the user presses a FINISHER button a3 and sets the type of stapling, namely, center stapling or side stapling.

Descriptions are given below of cases in which an A4Y sheet (or multiple A4 sheet) not folded as well as an A3 sheet (or multiple A3 sheets) folded are inserted in a single envelope.

Figure 26:
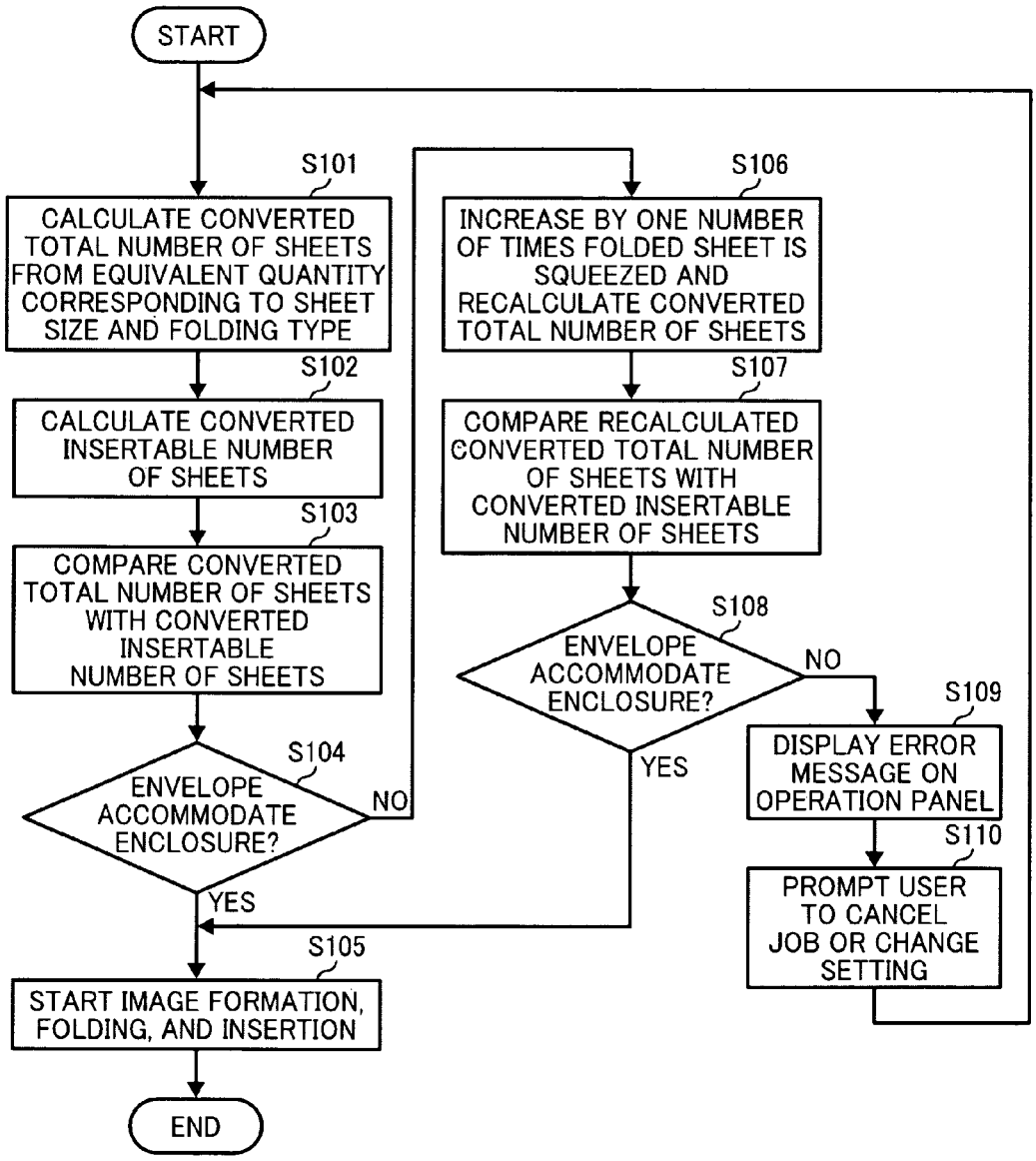
FIG. 26 is a flowchart illustrating a sequence of insertion processes executed after the user sets the type of folding on the display of the operation panel.

FIG. 26 is a flowchart illustrating a sequence of insertion processes executed after the user presses the INSERTION button a1 on the display 1-D of the operation panel 1-A and sets the folding style.

Table 1 illustrates relations among sheet sizes, folding styles, and first and second converted quantities or folding-related equivalent quantities for each sheet to be squeezed by the squeezing unit 200 and for each not to be squeezed by it. The first and second folding-related equivalent quantities increase as the folding number increases. Table 2 illustrates the relation between envelope types and maximum number of sheets insertable in the envelope.

TABLE 1

| Sheet size | Folding style (Folding number) | First equivalent quantity for each sheet (default, without additional squeezing) | Second equivalent quantity for each sheet (after additional squeezing is executed once) |
|---|---|---|---|
| A3 | Not folded | 1 | — |
| | Two | 2 | 1 |
| | Three | 3 | 2 |
| | Four | 4 | 3 |
| A4 | Not folded | 1 | — |
| | Two | 4 | 3 |
| | Three | 5 | 4 |
| | Four | 6 | 5 |

TABLE 2

| Envelope type | Maximum insertable number of sheets |
|---|---|
| A (for A4 size sheets) | 5 |
| B (for A4 size sheets) | 10 |
| C (for A3 size sheets) | 5 |
| D (for A3 size sheets) | 10 |

Tables 1 and 2 may be stored in the storage unit such as the RAM of the CPU 1U in the image forming apparatus 1, and the CPU 1U refers to those relations to execute predetermined calculations in the control described below.

It is to be noted that the converted quantity for each sheet not to be folded remains "1", and the unfolded sheet is not squeezed by the squeezing unit 200. Therefore, the equivalent quantity for each unfolded sheet to be squeezed once by the squeezing unit 200 is not available and shown as "-" in Table 1.

In other words, the number of times the squeezing unit 200 squeezes the sheet satisfies a relation:

$$N<M$$

wherein N is a positive integer representing the number of times the squeezing unit 200 squeezes the sheet and M is a positive integer representing the folding-related equivalent quantity for each sheet.

Additionally, although Table 1 illustrates only the relations regarding A3 size and A4 size, the image forming system according to the present can store data of relations between folding styles and the folding-related equivalent quantities regarding all sheet sizes insertable in envelopes.

In the flowchart shown in FIG. 26, after the user inputs the number of sheets inserted, the folding style, and the like on the display 1-D, at S101 the CPU 1U refers to Table 1 and calculates the converted number of sheets in total using the first folding-related equivalent quantity corresponding to the sheet type (e.g., sheet size and sheet thickness) and the folding style. At S102 the CPU 1U refers to Table 2 and calculates the number of sheets insertable in that envelope type (maximum insertable number of sheets). At S103, the CPU 1U compares the converted number of sheets in total with the maximum insertable number of sheets and at S104 determines whether the envelope can accommodate the enclosure. When the envelope can accommodate the enclosure (Yes at S104), at S105 the CPU 1U starts image formation on the sheet, folding the sheet, and inserting the sheet in the envelope.

By contrast, when insertion is not feasible (No at S104), at S106 the CPU 1U increases by one the number of times the squeezing unit 200 squeezes the folded sheet or multiple folded sheets (the number of times of the additional squeezing). Then, the CPU 1U refers to Table 1 and recalculates the converted number of sheets in total using the second folding-related equivalent quantity corresponding to the sheet type (i.e., sheet size and sheet thickness) and the folding style. Subsequently, at S107 the CPU 1U compares the recalculated converted number of sheets in total with the number of sheets insertable and at S108 determines whether the envelope can accommodate the enclosure. When insertion is executable (Yes at S108), the process proceeds to S105. Then, image formation on the sheet, folding the sheet, and inserting the sheet in the envelope are executed.

Figure 27:
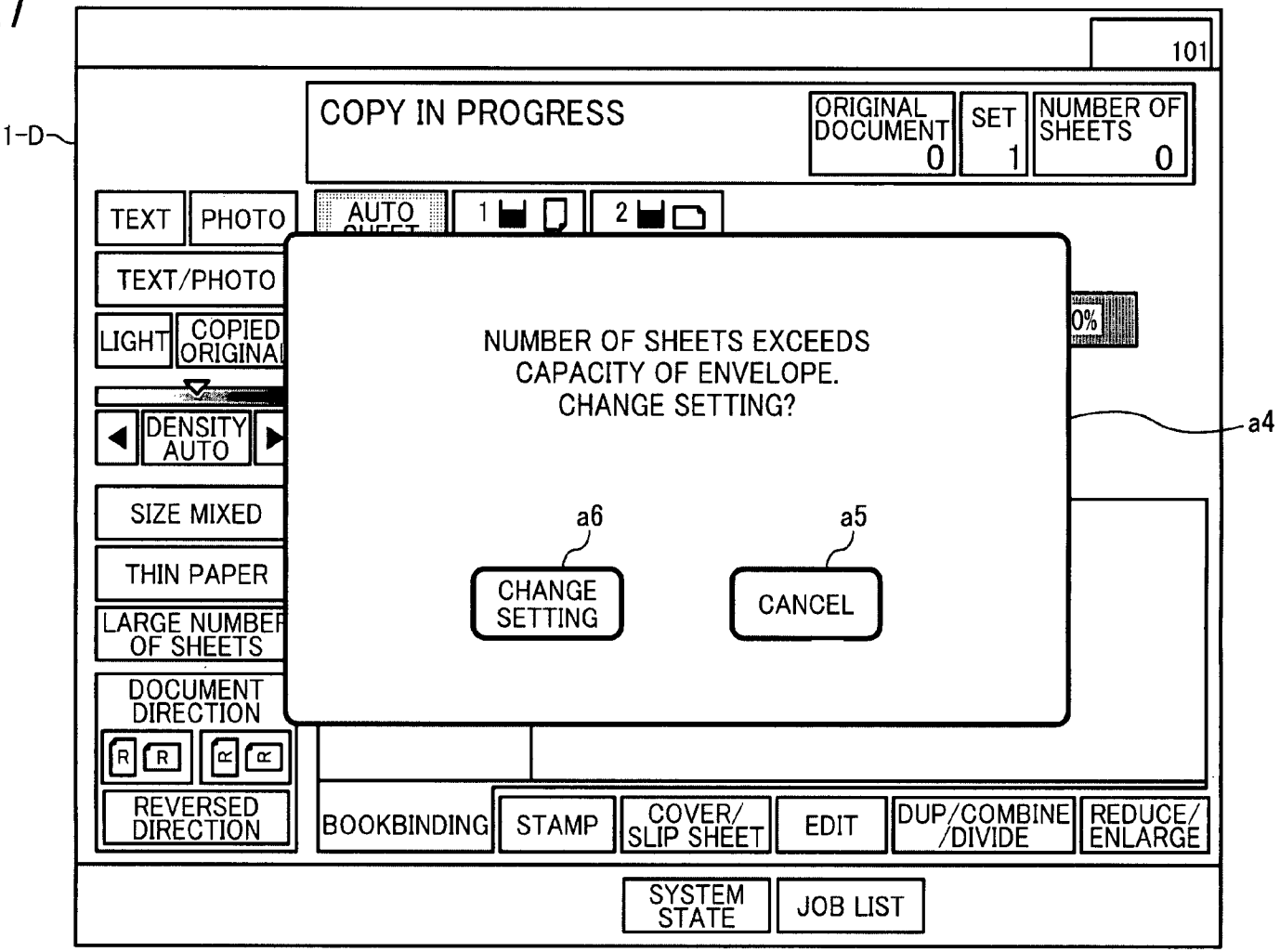
FIG. 27 illustrates an indication reporting an error that appears on the display of the operation panel.

By contrast, when insertion is not executable (No at S108), folding the sheet, and inserting the sheet in the envelope are not executed. At S109, the CPU 1U causes the display 1-D to display an error message as shown in FIG. 27. At S110, the display 1-D prompts the user to cancel the job or change setting of the job.

Specific cases are described below.

Case 1

In case 1, a unfolded single A4Y sheet as well as three A3 sheets folded in two are inserted in a single envelope of type B (see Table 2). The user inputs "one unfolded A4Y sheet" and "three A3 sheets folded in two" as the enclosure on the display 1-D. Then, the CPU 1U calculates the converted number of sheets in total using the first folding-related equivalent quantity corresponding to the sheet type and the folding style (S101).

Referring to Table 1, the CPU 1U retrieves, from the pre-stored table, the first folding-related equivalent quantity for each sheet corresponding to the sheet type and the folding style and then stores it. The first folding-related equivalent quantity of an unfolded A4 sheet remains "1". The first folding-related equivalent quantity of A3 size folded in two is "2", and three A3 sheets folded in two are equivalent to six unfolded sheets (2×3). Accordingly, the number of sheets in total is "7" (1+2×3).

Subsequently, the CPU 1U refers to Table 2 and obtains the converted insertable number of sheets (S102) and stores it. The maximum number of sheets insertable in the envelope of type A is "10". After these values are thus obtained, the CPU 1U compares the converted number of sheets in total, "7", with the maximum insertable number of sheets, "10". Since the envelope of type A can accommodate the converted number of the enclosures (7<10), the CPU 1U determines that image formation, folding, and insertion are feasible (S103 and S104) and starts the processing (S105).

Case 2

In case 2, a single A4Y sheet (not folded) as well as three A3 sheets (folded in two) are inserted in a single envelope of type A (see Table 2). After the user inputs insertion-related settings, the CPU 1U refers to Table 1 and retrieves the first folding-related equivalent quantity for each sheet corresponding to the sheet type and the folding style and stores it. Referring to Table 1, the first folding-related equivalent quantity of an unfolded A4Y sheet remains "1". The first folding-related equivalent quantity of A3 size folded in two is "2", and three A3 sheets folded in two are equivalent to six sheets (2×3). Accordingly, the converted number of sheets in total is calculated as follows (S101).

$$1+2\times3=7$$

The maximum number of sheets insertable in the envelope of type A is "5" (S102). When these values are compared with each other (S103), the converted number of sheets in total is greater than the maximum number of sheets insertable in the envelope of type A (7>5). Because the envelope cannot accommodate the converted number of the enclosures (S104), the CPU 1U recalculates the converted total number of sheets for a case in which additional squeezing is executed once. Referring to Table 1, when additional squeezing is executed once, the second folding-related equivalent quantity for a single A3 sheet folded in two is "1", and the converted total number of sheets is calculated as follows (S106).

$$1+1\times3=4$$

Accordingly, the converted total number of the enclosures is smaller than the maximum insertable number of sheets in the envelope (4<5). Then, the CPU 1U determines that the enclosures can be inserted in the envelope (S107 and S108) and starts the processing (S105).

It is to be noted that, because the initial position of the pressure roller 258 is outside the sheet conveyance path on the back side of the insertion device 4 as shown in FIG. 12, executing the additional squeezing once means that the pressure roller 258 moves from the back side to the front side of the device and returns to the back side once. Additionally, the number of times the additional squeezing is executed depends on the elasticity of the compression spring, and the pressure roller 258 may move only once from the back side to the front side of the device or from the front side to the back side of the device, not reciprocally.

Case 3

In case 3, two A4Y sheets (not folded) as well as five A3 sheets (folded in two) are inserted in a single envelope of type A (see Table 2), and the additional squeezing is performed once. After the user inputs insertion-related settings, the CPU 1U refers to Table 1 and retrieves the folding-related equivalent quantity for each sheet corresponding to the sheet type and the folding style and stores it. Referring to Table 1, the folding-related equivalent quantity of an unfolded A4Y sheet remains "1". The first folding-related equivalent quantity of A3 size folded in two is "2", and five A3 sheets folded in two are equivalent to 10 sheets (2×5). Accordingly, the converted number of sheets in total is calculated as follows (S101).

$$1\times2+2\times5=12$$

The maximum number of sheets insertable in the envelope of type A is "5" (S102). When these values are compared with each other (S103), the converted number of sheets in total is greater than the maximum number of sheets insertable in the envelope of type A (12>5). Because the envelope cannot accommodate the converted number of the enclosures (S104), the CPU 1U recalculates the converted number of sheets in total for a case in which additional squeezing is executed once. Referring to Table 1, the second folding-related equivalent quantity for a single A3 sheet folded in two is "1" when the sheet is to be squeezed once, and the converted total number of sheets is calculated as follows (S106).

$$1\times2+1\times5=7$$

Thus, the converted total number of sheets, "7", is greater than the maximum insertable number of sheets, "5", even after the additional squeezing is executed once (S107). The CPU 1U determines that insertion is not feasible (No at S108) and causes the display to display an error message such as the one shown in FIG. 27 (S109). Additionally, the CPU 1U prompts the user to cancel the job or change the setting of the job (S110). Referring to FIG. 27, the user can cancel the job by pressing a CANCEL button a5 or change the setting by pressing a CHANGE SETTING button a6 on the display 1-D. It is to be noted that the error message is not limited to the one shown in FIG. 27. For example, the display 1-D may report only cancellation of the job.

TABLE 3

| Sheet size | Folding style (Folding number) | Equivalent quantity for each sheet (default, without additional squeezing) | Deducted value per sheet for each additional squeezing |
|---|---|---|---|
| A3 | Not folded | 1 | — |
| | Two | 2 | −1 |
| | Three | 3 | −1 |
| | Four | 4 | −1 |
| A4 | Not folded | 1 | — |
| | Two | 4 | −1 |
| | Three | 5 | −1 |
| | Four | 6 | −1 |

Descriptions are made below of a procedure when the additional squeezing is performed twice or more.

Figure 28:
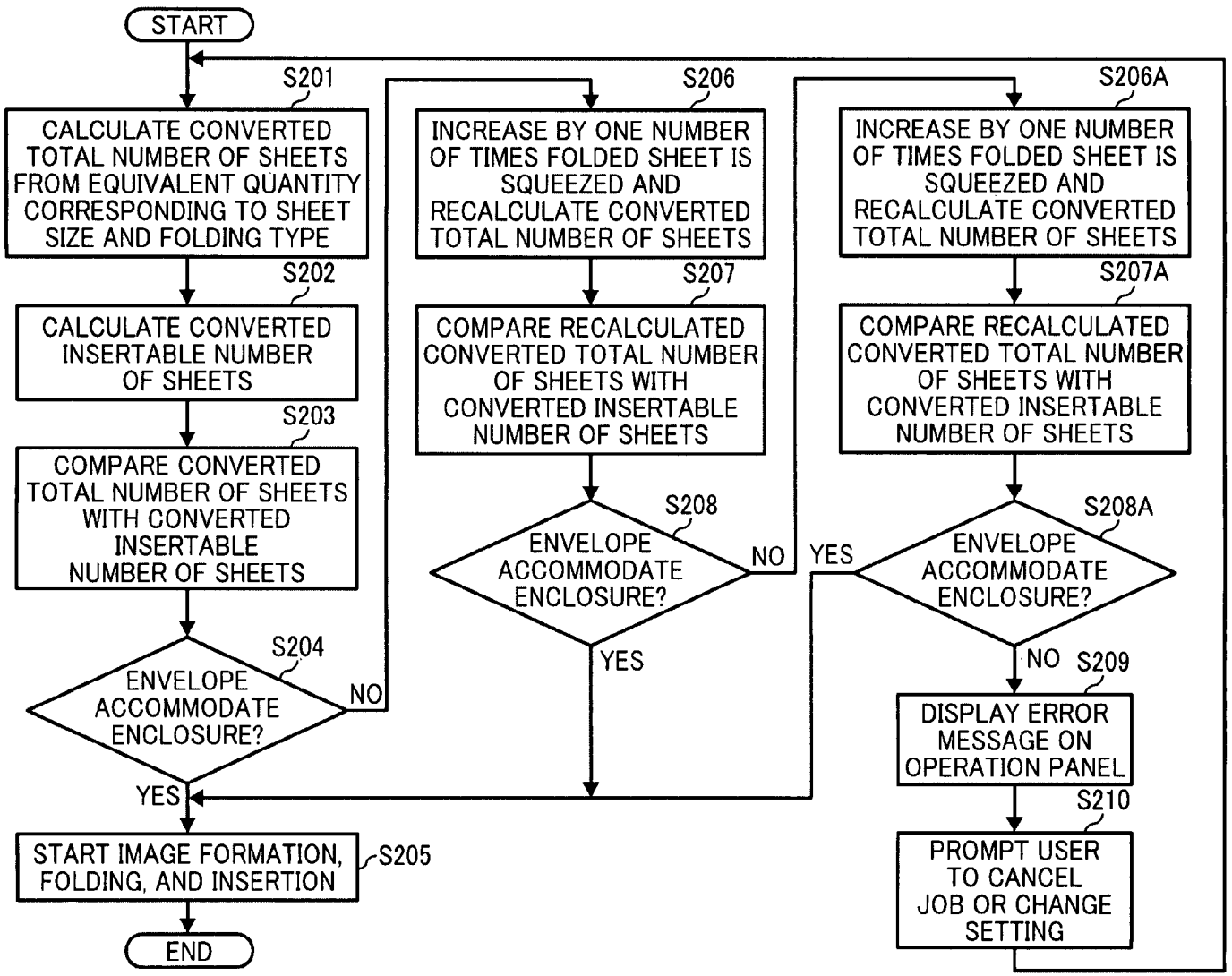
FIG. 28 is a flowchart of a procedure to insert enclosures in envelopes when the squeezing unit squeezes folded sheets twice.

FIG. 28 is a flowchart of a procedure when the additional squeezing is performed twice.

Steps from S201 through S210 shown in FIG. 28 are identical or similar to those from S101 through S110 shown in FIG. 26, and thus the descriptions thereof are omitted. The procedure shown in FIG. 28 are similar to that shown in FIG. 26 except the steps S206A, 207A, and 208A added between steps S108 and S109 in FIG. 26.

At S206A, the CPU 1U increases by one the number of times the folded sheet is to be squeezed by the squeezing unit 200. Then, the CPU 1U refers to Table 1 and recalculates the converted number of sheets in total using the second folding-related equivalent quantity corresponding to the sheet type (i.e., sheet size) and the folding style. It is to be noted that, at S206A, the number of times of the additional squeezing is not increased for folded sheets to be squeezed once, having a second folding-related equivalent quantity of "1".

Subsequently, at S207A the CPU 1U compares the recalculated converted number of sheets in total with the number of sheets insertable and, at 5208A, determines whether the envelope can accommodate the enclosure. When insertion is feasible (Yes at S208A), the process proceeds to S205. By contrast, when insertion is not feasible, the process proceeds to S209 and S210.

Case 4

As another case of the procedure shown in FIG. 28, two unfolded A4Y sheets, an A3 sheet folded in two, as well as five A3 sheets folded in three are inserted in an envelope of type B in case 4.

After the user inputs, on the display 1-D, that "two unfolded A4Y sheets", "one A3 sheet folded in two", and "five A3 sheets folded in three" are inserted in a B type envelope, the CPU 1U refers to Table 3 and obtains the folding-related equivalent quantities corresponding to the sheet type (i.e., sheet size) as well as the folding style and stores it. The folding-related equivalent quantity of an unfolded A4 sheet remains "1". The folding-related equivalent quantities of an A3 sheet folded in two and an A3 sheet folded in three are "2" and "3", respectively. Thus, the converted number of sheets in total can be calculated as follows.

$$1\times2+2\times1+3\times5=19$$

The CPU 1U refers to Table 2 and obtains the maximum number of sheets insertable in the B type envelope, which is "10" (S202), and stores it. When compared with each other (S203), the converted total number of sheets is greater than the maximum insertable number of sheets (19>10). Because the envelope cannot accommodate the converted number of the enclosures (No at S204), the CPU 1U recalculates the converted number of sheets in total for a case in which additional squeezing is executed once. Referring to Table 3, after the additional squeezing is executed once, the folding-related equivalent quantity of the A3 sheet folded in two can be calculated as 2−1=1 the folding-related equivalent quantity of the A3 sheet folded in three, to be squeezed once, can be calculated as 3−1=2. Accordingly, the converted total number of sheets can be calculated as follows (S206).

$$1\times2+1\times1+2\times5=13$$

As a result, the converted total number of sheets is "13", which is still greater than the maximum insertable number of sheets, "10" (S207). Because the envelope cannot accommodate the converted number of the enclosures (No at S208), the CPU 1U recalculates the converted number of sheets in total for a case in which additional squeezing is executed again, that is, twice.

Referring to Table 3, the when additional squeezing is to be executed again, the folding-related equivalent quantity for a single A3 sheet folded in three is "1" (3−1×2). The converted total number of sheets for one A3 sheet folded in two and five A3 sheets folded in three is calculated as 1×2+2×5=12.

Because the folding-related equivalent quantity of the A3 sheet folded in two, to be squeezing once is reduced to "1" at S206, the second squeezing is not executed on the A3 sheet folded in two at S206A. Thus, the folding-related equivalent quantity of the A3 sheet folded in two remains "1".

Accordingly, the converted number of sheets in total is calculated as "8" (1×2+1×1+1×5) at S206A.

When compared with each other, the converted total number of sheets is smaller than the maximum insertable number of sheets (8<10) at S207A. Thus, the envelope can accommodate the enclosures (Yes at S208A), and the process proceeds to S205. Then, image formation, folding, and insertion can be started.

By contrast, when the envelope still cannot accommodate the enclosure, the process proceeds to S209 and S210. The CPU 1U causes the display 1-D to display an error message as shown in FIG. 27 and prompts the user to cancel the job or change setting of the job.

It is to be noted that, in the relation among sheet type, folding style, and the folding-related equivalent quantity for each sheet shown Table 3, the folding-related equivalent quantity is deducted by one as the number of times of the additional squeezing is increased by one.

Additionally, in this calculation, the number of times of additional squeezing is not increased for the sheet whose folding-related equivalent quantity is "1" because the folding-related equivalent quantity should be 1 or greater.

Further, the relation shown in Table 3 can be stored in the RAM of the image forming apparatus 1 as a table. The CPU 1U refers to the relation in addition to Table 1 in performing the procedure shown in FIG. 28.

As described above, in the present embodiment, the system can determine whether the envelope can accommodate the enclosure when the user inputs the insertion-related settings including the envelope type, sheet type, and folding style before the post-processing apparatus 3 starts image formation on the sheet and folding the sheet. Further, when the envelope cannot accommodate the enclosure, the number of times folded sheets are squeezed is increased to reduce the thickness of the enclosure. Therefore, sheets are not wasted when the envelope cannot accommodate the enclosure and the productivity can be improved.

Additionally, the system can insert folded sheets and unfolded sheets together or multiple sheets folded in different styles in a single envelope.

The present embodiment can attain the following effects.

1) When insertion is not feasible, the number of times the folded enclosures is squeezed is increased to reduce the thickness of the enclosures. Therefore, the enclosure that is thicker than the capacity of the envelope can be squeezed to be insertable in the envelope.

2) The folding-related equivalent quantity for each folded sheet, based on which the CPU 1U determines whether insertion is feasible, is set separately for the sheet to be squeezed by the squeezing unit 200 and the sheet not to be squeezed. Thus, when the number of times the squeezing unit 200 squeezes the sheet is changed, in particular, the number of times of squeezing is increased, the converted quantity of the squeezed sheet can be smaller.

3) The CPU 1U can recognize that insertion is feasible after the converted quantity of the squeezed sheet is reduced and the envelope can accommodate the enclosure.

4) When setting insertion of enclosures including a folded sheet in envelopes, the user need not set whether the additional squeezing is performed or the number of times the additional squeezing is performed.

5) The system can automatically set whether the additional squeezing is performed and the number of times the additional squeezing is performed. Thus, functionality as well as usability of the system can be improved.

Numerous additional modifications and variations are possible in light of the above teachings. It is therefore to be understood that, within the scope of the appended claims, the disclosure of this patent specification may be practiced otherwise than as specifically described herein.

What is claimed is:

1. A recording media sheet processing system comprising:

a folding device, including a folding unit to fold a sheet of recording media and a squeezing unit to squeeze a folded portion of the folded sheet;

an insertion device to insert in an envelope an enclosure including the folded sheet; and a controller operatively connected to the folding device and the insertion device and including:

an envelope selector for selecting an envelope type from a group of selectable predetermined envelope types;

a selector for selecting whether to fold the sheet inserted in the envelope and a folding style of the sheet from a group of selectable predetermined folding styles;

a first storage unit to store a first folding-related equivalent quantity into which a quantity of each sheet not to be squeezed by the squeezing unit of the folding device is converted corresponding to the selected folding style;

a second storage unit to store a maximum quantity of sheets insertable in each envelope type;

a calculator to calculate a total converted quantity of the enclosure using the first folding-related equivalent quantity stored in the first storage unit and the folding style selected by the selector;

a determination unit to compare the calculated total converted quantity of the enclosure with the maximum quantity of sheets insertable in the selected envelope type and to determine whether the selected envelope type accommodates the enclosure and a squeezing setter to set the number of times the squeezing unit squeezes the sheet and to increase the number of times the squeezing unit squeezes the sheet when the determination unit determines that insertion is not feasible, the controller causing the recording media sheet processing system to start processing the sheet and the insertion device to insert the enclosure in the envelope when the determination unit determines that insertion is feasible.

2. The recording media sheet processing system according to claim 1, wherein the first storage unit further stores a second folding-related equivalent quantity into which the quantity of each sheet is converted corresponding to the number of times the sheet is squeezed as well as the selected folding style when the number of times the sheet is squeezed, set by the squeezing setter, is one or greater.

3. The recording media sheet processing system according to claim 2, wherein the calculator recalculates the total converted quantity of the enclosure using the second folding-related equivalent quantity corresponding to the number of times the sheet is squeezed as well as the folding style.

4. The recording media sheet processing system according to claim 3, wherein the determination unit compares the total converted quantity of the enclosure, recalculated using the second folding-related equivalent quantity, with the maximum quantity of sheets insertable in the selected envelope type and determines whether the selected envelope type accommodates the enclosure.

5. The recording media sheet processing system according to claim 4, further comprising a display to report an error when the determination unit determines that insertion is not feasible even if the folded sheet is squeezed by the squeezing unit of the folding device.

6. The recording media sheet processing system according to claim 4, further comprising a job canceller to cancel a current jot when the determination unit determines that insertion is not feasible.

7. The recording media sheet processing system according to claim 4, further comprising a setting changer to change one or more settings of a current job when the determination unit determines that insertion is not feasible.

8. The recording media sheet processing system according to claim 1, wherein the number of times the squeezing unit squeezes the sheet, set by the squeezing setter, satisfies a relation $N<M$ wherein N is a positive integer representing the number of times the squeezing unit squeezes the sheet and M is a positive integer representing the first folding-related equivalent quantity for each sheet.

9. The recording media sheet processing system according to claim 1, wherein the squeezing setter sets the number of times the squeezing unit of the folding device squeezes the sheet to zero when the first folding-related equivalent quantity thereof is 1.

10. The recording media sheet processing system according to claim 1, wherein the group of selectable folding styles comprises at least one of folding sheets in two, three, and four; and folding sheets into a Z-like shape, a double door-like shape, and an accordion-like shape.

11. The recording media sheet processing system according to claim 1, wherein the enclosure contains an unfolded sheet in addition to the folded sheet.

12. An image forming system comprising:

an image forming apparatus including an image forming unit to form images on the sheets of recording media; and the recording media sheet processing system according to claim 1, wherein the controller is included in the image forming apparatus, the folding device is connected to a downstream side of the image forming apparatus, and the insertion device is connected to a downstream side of the folding device.

* * * * *